US007900681B2

(12) United States Patent
Sweeney

(10) Patent No.: US 7,900,681 B2
(45) Date of Patent: Mar. 8, 2011

(54) COLONIAL STORM SHUTTER WITH IMPROVED STRENGTH AND FABRICABILITY

(75) Inventor: John Sweeney, Fort Pierce, FL (US)

(73) Assignee: Extreme Impact Shutter Supply, Inc., Sebastian, FL (US)

( * ) Notice: Subject to any disclaimer, the term of this patent is extended or adjusted under 35 U.S.C. 154(b) by 137 days.

(21) Appl. No.: 12/139,343

(22) Filed: Jun. 13, 2008

(65) Prior Publication Data

US 2008/0245024 A1 Oct. 9, 2008

(51) Int. Cl.
*E05D 15/26* (2006.01)

(52) U.S. Cl. ..... 160/210; 49/67; 49/50

(58) Field of Classification Search ..... 160/117, 160/210, 209; 49/56, 67, 63, 50, 394; 52/202, 52/204.68, 203, 473
See application file for complete search history.

(56) References Cited

U.S. PATENT DOCUMENTS

| | | | | |
|---|---|---|---|---|
| 2,835,935 | A * | 5/1958 | Housley | 52/507 |
| 3,394,518 | A * | 7/1968 | Worrell, Jr. | 52/473 |
| 4,733,515 | A * | 3/1988 | Schmidlin | 52/473 |
| 5,383,315 | A * | 1/1995 | Birs | 52/202 |
| 5,848,505 | A | 12/1998 | Taylor | |
| 5,907,929 | A | 6/1999 | Poma et al. | |
| 6,470,639 | B1 | 10/2002 | Horn et al. | |
| 6,543,188 | B1 | 4/2003 | Poma et al. | |
| 6,604,322 | B2 | 8/2003 | Horn et al. | |
| 6,877,285 | B2 * | 4/2005 | Poma et al. | 52/202 |
| 6,935,082 | B2 * | 8/2005 | Hemstreet et al. | 52/473 |
| 6,996,934 | B2 | 2/2006 | Briscoe et al. | |
| 7,080,490 | B2 | 7/2006 | Horne et al. | |
| 7,131,480 | B2 * | 11/2006 | Briscoe et al. | 160/117 |
| 2002/0056230 | A1 | 5/2002 | Horn et al. | |
| 2002/0162277 | A1 | 11/2002 | Foster et al. | |
| 2002/0194804 | A1 | 12/2002 | Horn et al. | |
| 2003/0089463 | A1 | 5/2003 | Briscoe et al. | |
| 2003/0110725 | A1 * | 6/2003 | Hemstreet et al. | 52/473 |
| 2003/0140560 | A1 | 7/2003 | Poma et al. | |
| 2003/0200715 | A1 | 10/2003 | Blackwell et al. | |
| 2003/0221380 | A1 | 12/2003 | Kreps et al. | |
| 2004/0003540 | A1 | 1/2004 | Horn et al. | |
| 2004/0035056 | A1 | 2/2004 | Briscoe et al. | |
| 2005/0022463 | A1 | 2/2005 | Blackwell et al. | |
| 2005/0193651 | A1 | 9/2005 | Kirk | |
| 2005/0284026 | A1 | 12/2005 | DuBose et al. | |
| 2006/0027345 | A1 | 2/2006 | Briscoe et al. | |
| 2006/0162266 | A1 | 7/2006 | Hay, III | |
| 2006/0242919 | A1 | 11/2006 | Jaycox | |
| 2008/0110218 | A1 * | 5/2008 | Allen et al. | 70/158 |
| 2008/0178540 | A1 * | 7/2008 | Salzer | 52/202 |
| 2009/0160200 | A1 * | 6/2009 | Greenway et al. | 292/268 |
| 2009/0183447 | A1 * | 7/2009 | Hay et al. | 52/202 |
| 2009/0266012 | A1 * | 10/2009 | Allen et al. | 52/202 |

* cited by examiner

*Primary Examiner* — Blair M. Johnson
(74) *Attorney, Agent, or Firm* — The Marbury Law Group PLLC

(57) ABSTRACT

A colonial storm shutter assembly with improved impact resistance includes shutter blade elements having a corrugated configuration that exhibits superior structural strength and bending resistance while providing an attractive face. Triple, double and single shutter blade elements overlap to provide enhanced structural strength and simplify assembly. Side frame structures include a reinforcing portion on the outside wall which provides increased strength particularly in the miter joint with top and bottom frame structures. A storm bar includes a center storm bar clip which bolts to the side frames of two shutter panels when in the closed configuration to provide enhanced structural rigidity. Center fastening angles are bolted to the side and top/bottom frames at both the top and bottom where the two shutter panels meet in the closed configuration to provide further structural strength and resistance to opening.

21 Claims, 15 Drawing Sheets

COLONIAL STORM SHUTTER WITH IMPROVED STRENGTH AND FABRICABILITY

FIELD OF THE INVENTION

The present invention relates generally to storm shutters, and more particularly to colonial storm shutters with improved impact resistance and fabricability.

BACKGROUND

For centuries, storm shutters have been used to protect windows and doors from high winds and impacts by materials propelled by storm winds. Along the Atlantic and Gulf coasts of the United States, storm shutters are particularly important to protect against hurricanes and nor'easters, and in many places are required by building codes and insurance companies. Recent hurricanes landfalls in Florida and the Gulf states have graphically demonstrated the importance of building coastal properties to withstand such storms, including providing storm shutters with sufficient mechanical strength to withstand the full force of hurricane winds. Thus, there is an urgent need for storm shutter systems with enhanced strength to withstand high winds and resist impacts from objects propelled by such winds.

SUMMARY

The various embodiments provide colonial storm shutter designs with improved impact resistance which is achieved at reduced fabrication cost and complexity. Shutter blade elements are formed with a corrugated configuration that exhibits superior structural strength and bending resistance while providing an attractive face. Triple, double and single shutter blade elements fit together in a simple overlap configuration which provides enhanced structural strength and simple assembly. Side frame structures include a reinforcing portion on the outside wall which provides increased strength and bending resistance. A storm bar includes a center storm bar clip which bolts to the side frames of two shutter panels when in the closed configuration to provide enhanced structural rigidity. Center fastening angles are attached to the side and top/bottom frames at both the top and bottom where the two shutter panels meet in the closed configuration to provide further structural strength and resistance to opening.

BRIEF DESCRIPTION OF THE DRAWINGS

The accompanying drawings, which are incorporated herein and constitute part of this specification, illustrate exemplary embodiments of the invention. Together with the general description given above and the detailed description given below, the drawings serve to explain features of the invention.

DETAILED DESCRIPTION

Figure 1:
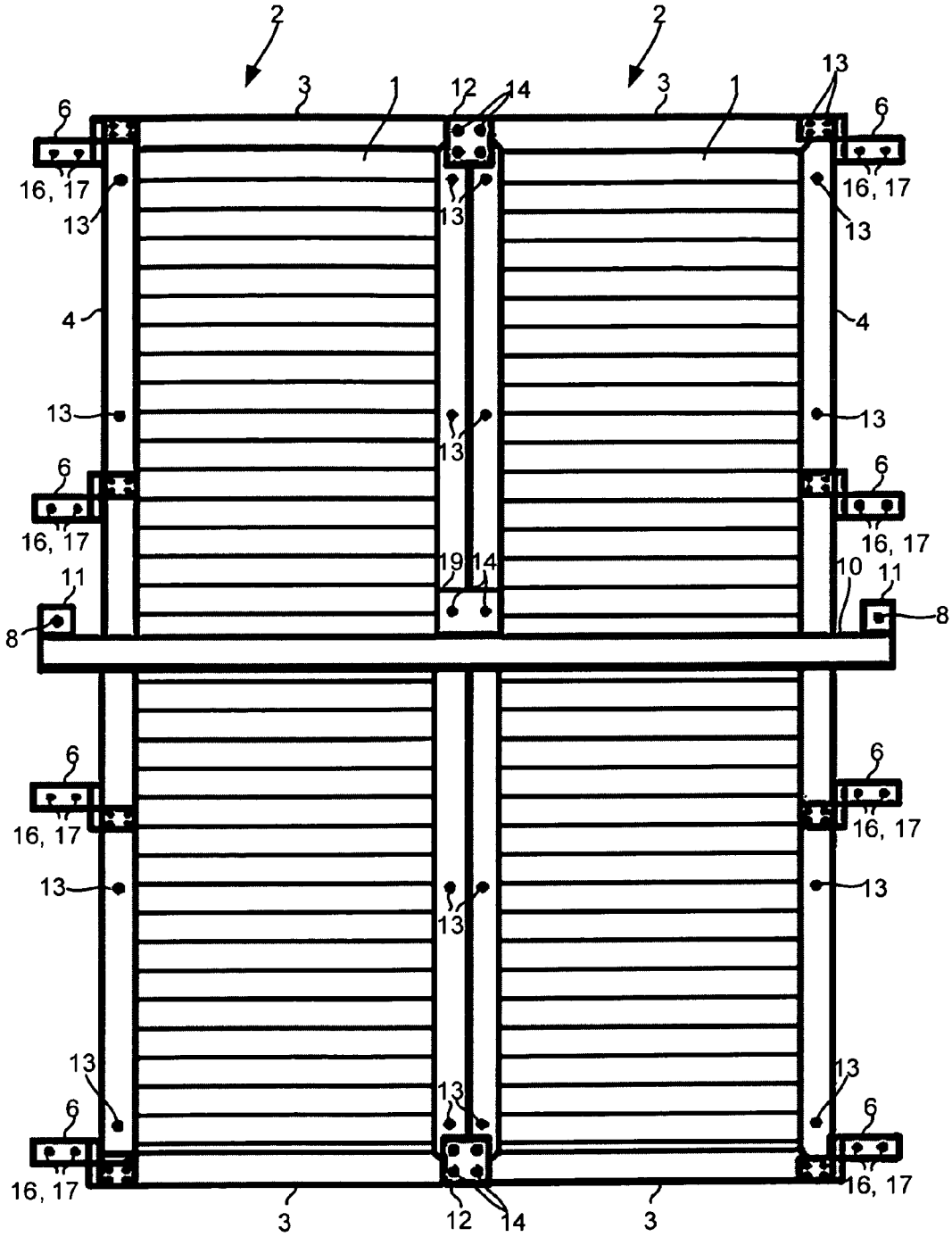
FIG. 1 is an elevation view of a colonial shutter in a closed configuration according to an embodiment.

Various embodiments will be described in detail with reference to the accompanying drawings. Wherever possible, the same reference numbers will be used throughout the drawings to refer to the same or like parts. References made to particular examples and implementations are for illustrative purposes and are not intended to limit the scope of the invention or the claims.

As used herein, the terms "about" or "approximately" for any numerical values or ranges indicates a suitable dimensional tolerance that allows the part or collection of components to function for its intended purpose as described herein. As used herein, the terms "fastener" and "mechanical fastener" are intended to encompass all known devices, methods and materials used for attaching two or more components together, including but not limited to any one or combination of the following: threaded bolts, threaded bolts with nuts, screws, pin, rivets, pop rivets, welding, nails, adhesives and equivalents thereof. Further, references herein to "fastener" are not intended to limit the scope of the invention or the claims to the type or arrangement of example fasteners illustrated in the drawings unless a particular type of fastener is specifically recited in the claims.

The various embodiments provide a storm shutter design which is capable of withstanding the high wind and large impact load expected from large huricanes. Shutter blade elements are formed with a corrugated configuration that exhibits superior structural strength and bending resistance while providing an attractive face. Triple, double and single shutter blade elements fit together in a simple overlapping configuration which provides enhanced structural strength and simple assembly. Side frame structures include a reinforcing portion on the outside wall which provides increased strength and bending resistance. An "L" shaped storm bar includes a center storm bar clip which bolts to the side frames of two shutter panels when in the closed configuration to provide enhanced structural rigidity. Center fastening angles are attached to the side frame at both the top and bottom of each of the two shutter panels when in the closed configuration to provide further structural strength and resistance to opening. The storm shutters according to the various embodiments are easy to assemble, requiring fewer assembly steps and fastener installations. The storm shutters according to the various embodiments are also easy to deploy into the closed configuration requiring the attachment of only a few parts with simple machine bolts.

Figure 2:
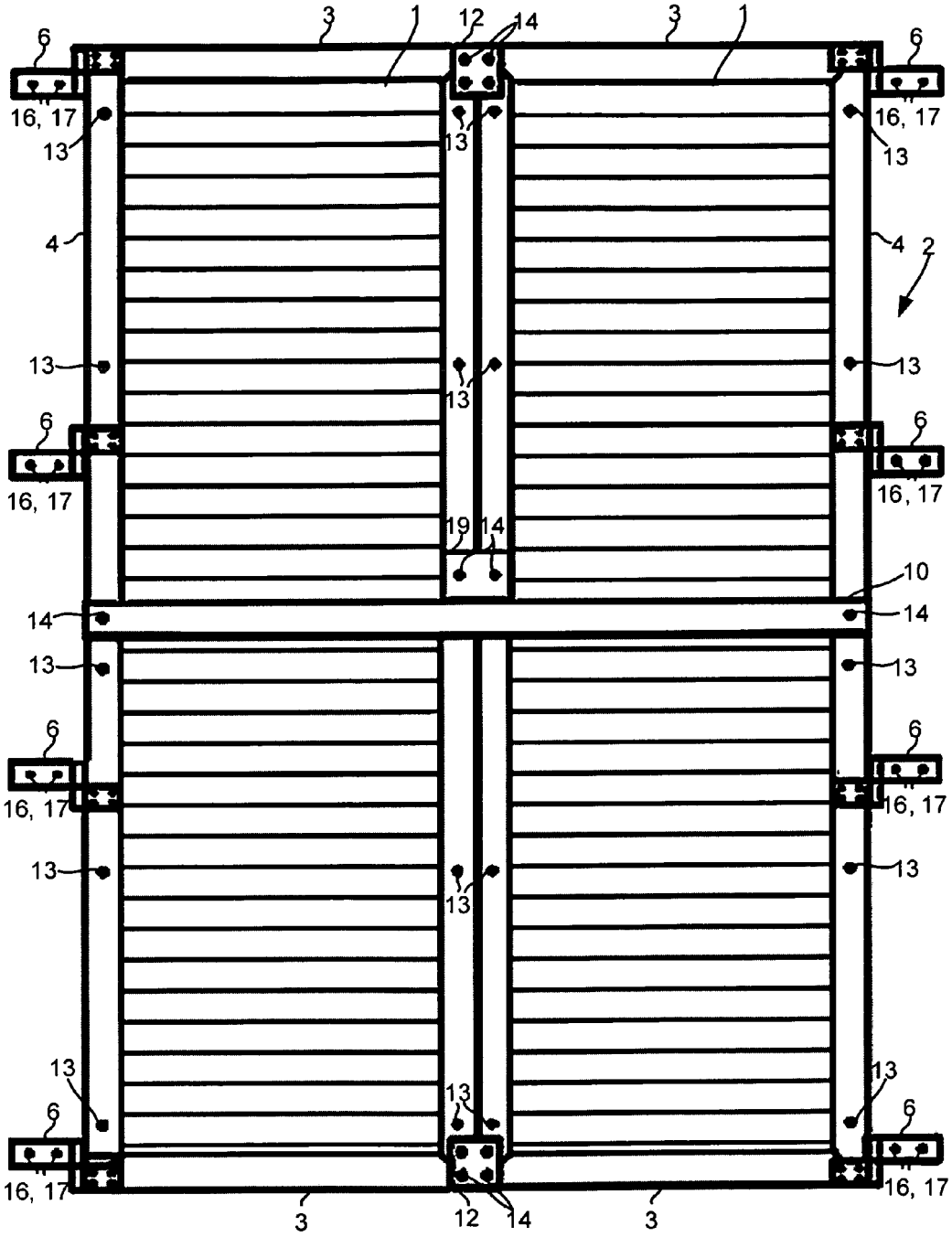
FIG. 2 is at an elevation view of a colonial shutter in a closed configuration according to a second embodiment.

FIG. 1 provides an elevation view of an embodiment storm shutter assembly attached to a structure in the closed configuration. In the embodiment illustrated in FIG. 1, the storm shutter assembly includes two shutter panels 2 attached by hinges 6 on either side of an opening in a structure, such as a window or door. In the open configuration (not shown), each of the two shutter panels 2 fold back over the structure about hinges 6, thereby framing the window or door in the conventional manner well known to colonial storm shutters. To position the shutter panels 2 in the closed configuration illustrated in FIG. 1, each shutter panel 2 is pivoted about the hinges 6 to the closed position where the two panels nearly touch. A storm bar 10 is positioned in front of the shutter panels 2 and attached to the structure (as illustrated in FIG. 1 and described in more detail below) or to the outside shutter panel side frames 4 (as illustrated in FIG. 2 and described in more detail below). A center storm bar clip 19, which is attached to the middle of the storm bar 10, is bolted to the inner shutter panel side frames 4 with machine bolts 14 which thread in two rivnuts 15 as described in more detail below with reference to FIG. 14. A center fastening angle 12 is then bolted to the inner shutter panel side frames 4 at the top and bottom of the shutter with machine bolts 14 which thread into rivnuts 15 as described in more detail below with reference to FIGS. 13 and 15. So configured, the storm shutter is now prepared to endure hurricane strength winds and associated debris hits.

Each shutter panel 2 is formed from two side frames 4 joined at the top and bottom to top and bottom frames 3 which together hold in place a plurality of shutter blade elements 1 which span the opening between the side frames. The side frames 4 are joined to the top and bottom frames 3 in miter joints which can be secured in part by hinges 6 coupled with mechanical fasteners 13 such as rivets or pop rivets. In particular, the hinges 6 are positioned at the top and bottom of each shutter panel and configured so the shutter-side portion of the hinge 6 is attached by mechanical fasteners 13 to both the bottom or top frame 3 and the adjoining side frame 4, thereby providing a structural connection between the two members. In an embodiment, each hinge 6 is attached to the side (and at the top and bottom also to the top and bottom frames 3) by four mechanical fasteners 13, such as rivets. Using four fasteners 13 instead of the customary two fasteners provides increase structural strength. Also, in an embodiment using four fasteners 13 to attach the shutter-side portion of the hinges 6 at the top and bottom corners of the shutter panels 2, enables the hinges 6 to be attached so that two fasteners 13 engage the side frame 4 and two fasteners 13 to engage the top or bottom frame 4, thereby using the hinge bases as a strap to further connect the side frame 4 to the top and bottom frames 3.

Figure 4:
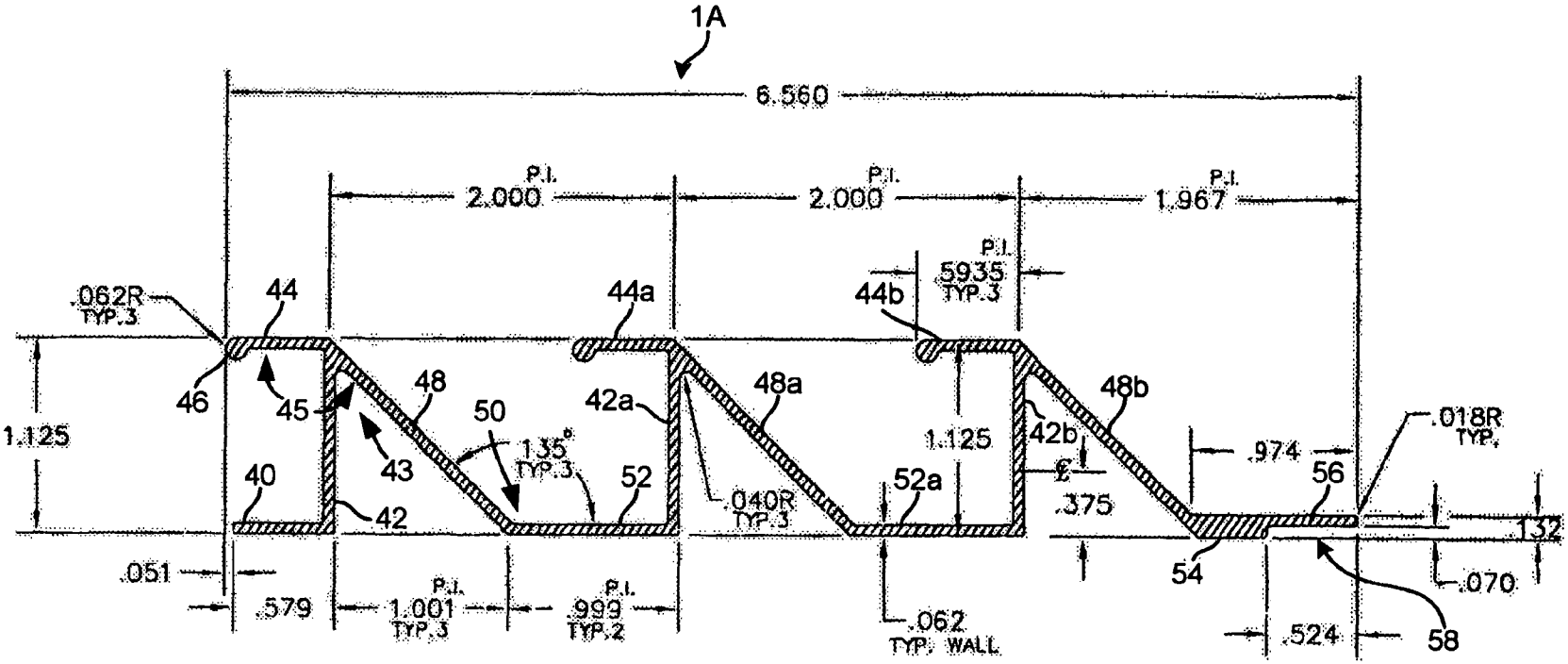
FIG. 4 is a cross-sectional view of a triple shutter blade element according to an embodiment.
Figure 5:
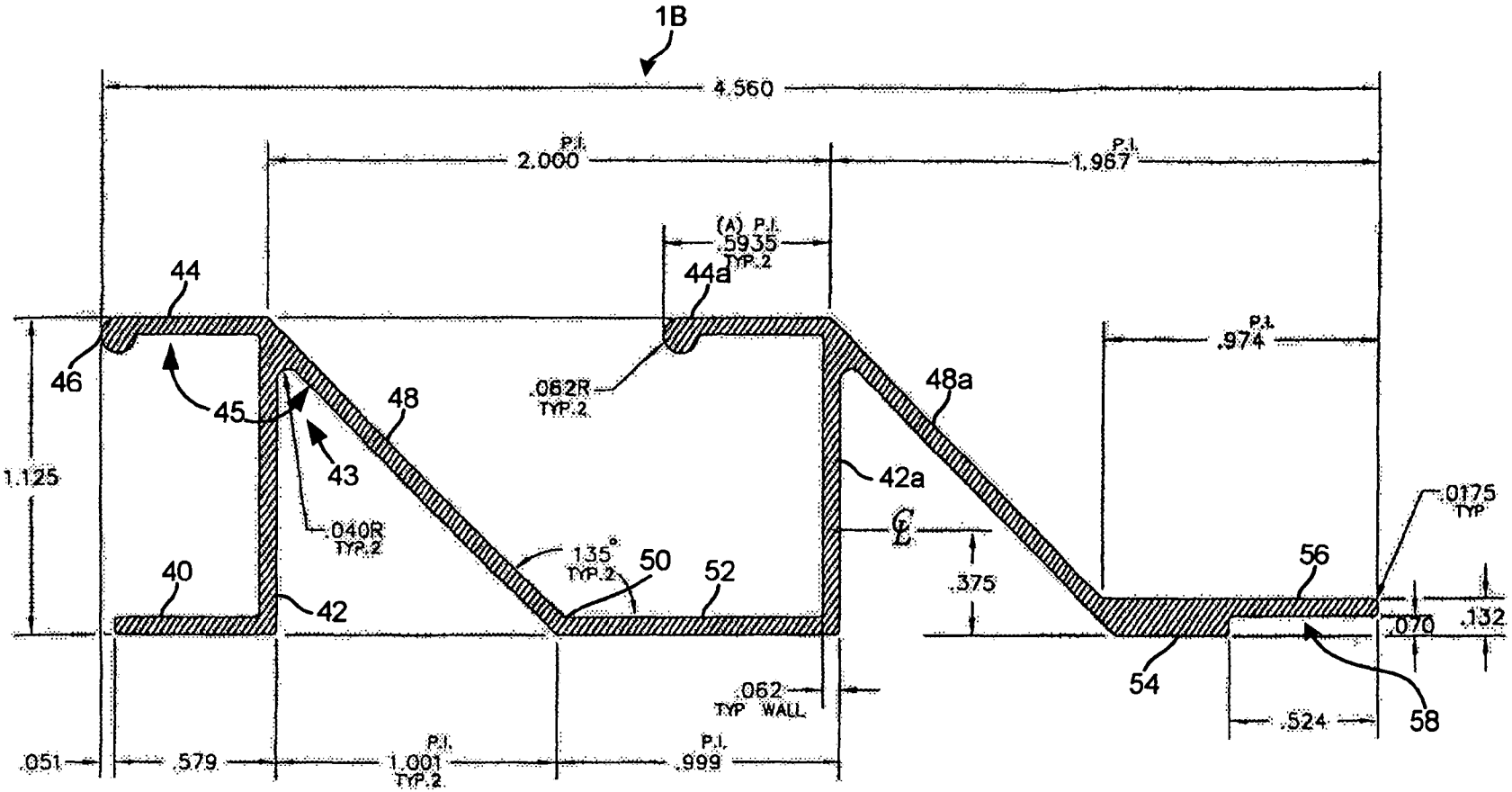
FIG. 5 is a cross-sectional view of a double shutter blade element according to an embodiment.
Figure 6:
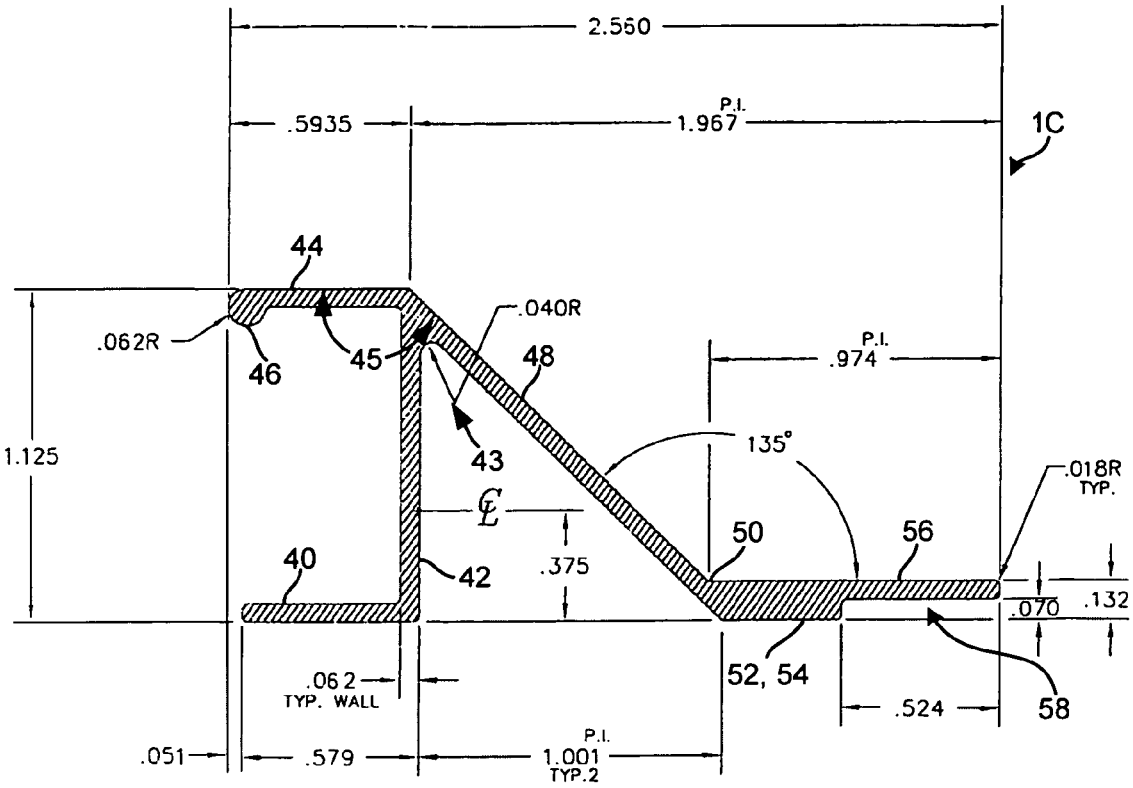
FIG. 6 is a cross-sectional view of a single shutter blade element according to an embodiment.

As described in more detail below, either end the shutter blade elements 1A, 1B, 1C (which are illustrated in FIGS. 4-6) fit within the open side of the side frames 4 with the shutter blade elements 1A, 1B, 1C extending horizontally between the two side frames 4. As described more fully below, the various shutter blades 1A, 1B, 1C overlap to provide a continuous structure extending between the top and bottom frames 3. The shutter blade elements 1A, 1B, 1C held in place by fitting closely within the side frame 4 structure. At selected intervals along the side frames 4, such as at 16 inch spacing (approx.), shutter blade elements 1A, 1B, 1C may be further secured to the side frames 4 by mechanical fasteners 13, such as rivets or pop rivets.

FIG. 1 shows some of the features which provide the storm shutter assembly with enhanced structural strength. Each of the shutter panels 2 exhibit exceptional structural strength due in part to the unique structure for the shutter blades 1 and side frames 4 which are described below with reference to FIG. 4 and FIG. 7. Additionally, the storm shutter assembly hinges 6 are positioned at the top and bottom corners, center fastening angles 12 bolted to the top and bottom of the inner side frames 4 where the two shutter panels 2 meet, and a center storm bar 10 including a center storm bar clip 19 bolted to the center portion of the inner side frames 4 where the two shutter panels 2 meet combine to reinforce the structural strength of the shutter panels when the assembly is in the closed position. Further strength is provided by using four mechanical fasteners 13 (e.g., rivets) to attach each hinge 6 to a side frame 4 instead of the conventional practice of using only two fasteners.

An optional design embodiment concerns the attachment of the storm bar 10 to the building or shutter assembly. In one embodiment illustrated in FIG. 1, the storm bar is attached to the building by a wall fastening angle 11 on either side of the storm shutter assembly. In an alternative embodiment illustrated in FIG. 2, the storm bar 10 can be attached to the outer side frame 4 with a machine bolt 14 which threads into a rivnut 15 positioned within the side frame 4 as described more fully below with reference to FIG. 20. With the exception of the storm bar attachment, the embodiment illustrated in FIG. 2 is substantially the same as that described above with reference to FIG. 1.

The various embodiments can be configured and sized to fit a wide variety of building openings and be attached to a variety of building materials, including wood frames and cement block. For example, the storm shutter embodiment illustrated in FIG. 1 is sized to fit a 48"×72" window opening, while the example bifold storm shutter embodiment illustrated in FIG. 3 can be sized to fit a 96"×112" window or sliding glass door opening. This wide range of size compatibility is achieved without the need for different components, since the side frames 4, top and bottom frames 3, shutter blades 1 and storm bars 10 are all extruded aluminum pieces of fixed cross-sections that can be cut to length. Thus, a single colonial storm shutter design can be adapted to practically any size building opening and achieve the same level of structural integrity without the need for a plurality of different components or installation configurations.

Figure 3:
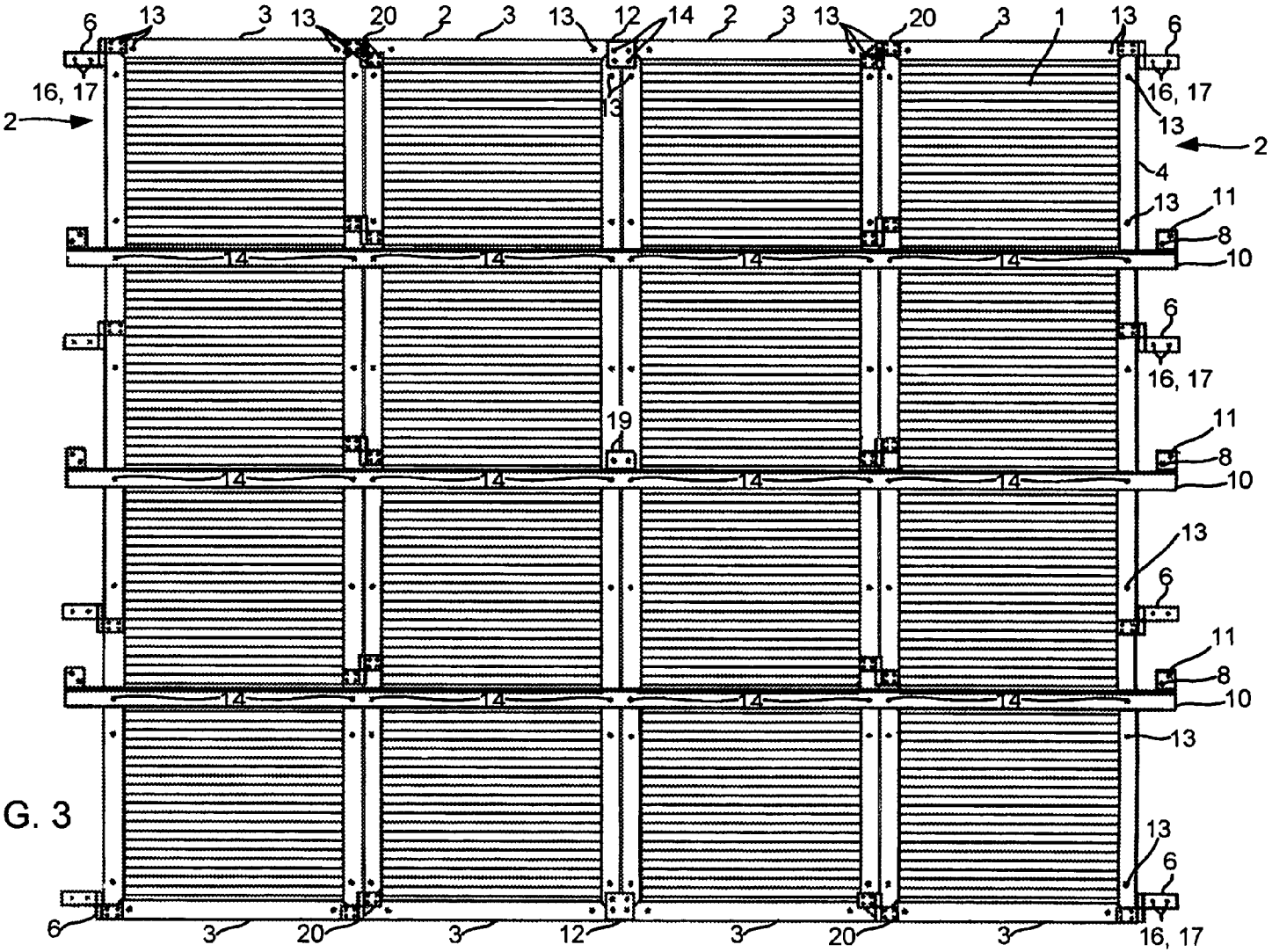
FIG. 3 is an elevation view of a bifold colonial shutter in a closed configuration according to a third embodiment.

Referring to FIG. 3, a bifold shutter assembly includes shutter-to-shutter hinges 20 between two shutter panels 2 to form a bifold assembly. In this manner, a bifold assembly having an attractive width when in the open configuration, such as 28" as in the case of a 112" wide bifold shutter assembly, can span the full width of a large opening. Each of the shutter-to-shutter hinges 20 are attached to a side frame 4, and in the case of the top and bottom corners also to the top or bottom frame 3, with four mechanical fasteners 13. When deployed in the closed configuration, with the center-most shutter panels 2 mechanically coupled by the center storm bar clip 19 and center fastening angles 12, the shutter assembly forms a near rigid structure extending between the wall mounting hinges 6, with additional reinforcement provided by one or more storm bars 10. In the 96"×112" bifold shutter assembly illustrated in FIG. 3, three storm bars 10 may be used to provide reinforcing over the entire width and height of the storm shutter assembly. As a option for strengthening the bifold shutter assembly, each storm bar 10 can also be bolted to each side frame 4 using machine bolts 14 engaged into rivnuts 15 secured in the side frames 4 in the same manner as the rivnuts 15 used to connect the center storm bar clip 19.

Referring to both FIG. 1 and FIG. 3, the various embodiments make use of the hinge 6, 20 attachments and center fastening angle 12 to provide additional structural connections between the top or bottom frame 3 and adjoining side frame 4. Using four mechanical fasteners 13 (such as rivets or pop rivets) which engage both the top or bottom frame 3 and adjoining side frame 4 to connect the hinges 6 to each shutter panel 2 provides a rigid structural connection between the frame pieces. Similarly, the use of the center fastening angle which bolts into both the top or bottom frame 3 and the adjoining side frame 4 provides a rigid mechanical connection between these two structures when in the closed configuration. Thus, the use of these structures in combination with the reinforced miter joints securely fastens the frame members together while eliminating the need for other structural connecting/reinforcing hardware. These design elements reduce hardware costs and inventory, and eliminates assembly steps, thereby reducing the overall cost of the storm shutter assembly while enhancing overall structural strength.

The shutter blades 1 can be configured in triple blade, double blade and single blade elements 1A, 1B, 1C (as illustrated in FIGS. 4-6) to facilitate assembling storm shutters to fit various size window and door openings. In a preferred embodiment, the triple blade, double blade and single blade elements are formed of extruded aluminum having a nominal wall thickness of approximately 0.062 inches.

FIG. 4 shows a cross-section of the triple blade element 1A according to a preferred embodiment. The shutter blades are configured with a unique corrugated profile which provides enhanced structural performance while providing an attractive front when in the open configuration. The corrugated profile includes a repeating pattern of surfaces which from the front side in the open configuration appears as a series of canted blades. In particular, the corrugated profile features a vertical underlap portion 40 connected at approximately a right angle to a first horizontal portion 42 which connects at approximately a right angle to a first front vertical cantilever portion 44. A first diagonal portion 48 connects to the first horizontal portion 42 at an acute angle 43 and to the first front vertical cantilever portion 44 at an obtuse angle 45 on one end and to a first back vertical portion 52 on the other end at an obtuse angle 50. In a preferred embodiment, the horizontal portion-to-diagonal portion acute angle 43 is about 45°, the front vertical portion-to-diagonal portion obtuse angle is about 135° and the diagonal portion-to-back vertical portion obtuse angle 50 is about 135°. On the free end of the front vertical cantilever portion 44 is formed a radiused portion 46. In a preferred embodiment, the radiused portion 46 has a radius of approximately 0.062 inches.

In the triple blade element 1A, the corrugated profile continues with the first back vertical portion 52 connecting at approximately a right angle to a second horizontal portion 42*a* which connects to a second front vertical cantilever portion 44*a* and a second diagonal portion 48*a* which connects to a second back vertical portion 52*a*. Similarly, the second back vertical portion 52*a* connects at approximately a right angle to a third horizontal portion 42*b* which connects to a third front vertical portion 44*b* and a third diagonal portion 48*b*. The third diagonal portion 48*b* connects at an obtuse angle to a vertical back joint transition portion 54. The joint transition portion 54 adjoins to a vertical overlap portion 56 which is thinner than the joint transition portion 54 leaving a vertical gap 58. The vertical overlap portion 56, vertical gap 58 and joint transition portion 54 are configured so that the vertical underlap portion 40 of an adjoining blade element will fit into the vertical gap 58 so that the back surfaces of the joint transition portion 54 and the underlap portion 40 are approximately parallel.

FIG. 5 shows a cross-section of the double blade element 1B according to a preferred embodiment. The double blade element 1B features the same corrugated profile as described above with reference to FIG. 4 with the exception that there are only two blade patterns (i.e., two horizontal portions 42, 42*a*, two vertical front cantilever portions 44, 44*a* and two diagonal portions 48, 48*a*). With the exception of the overall length, the shapes and dimensions of the double blade element 1B are substantially the same as those of the triple blade element 1A.

Similarly, FIG. 6 shows a cross-section of the single blade element 1C according to a preferred embodiment. The single blade element 1C features the same corrugated profile as described above with reference to FIG. 4 with the exception that it includes only a single blade pattern (i.e., one horizontal portion 42, one vertical front cantilever portion 44 and one diagonal portion 48). Also, the back vertical portion 52 is the same as the joint transition portion 54. With the exception of the overall length, the shapes and dimensions of the single blade element 1C are substantially the same as those of the triple blade element 1A.

In a preferred embodiment, the triple, double and single blade elements 1A, 1B, 1C have the dimensions shown in FIGS. 4-6. In particular, in the preferred embodiment the horizontal portion 42 of the blade elements is sized so that the front surface of the front vertical cantilever portion 44 and back surfaces of the vertical underlap portion 40 and the back vertical portion 52 are approximately 1.125 inches apart which defines the depth of the cantilever blades 1. Further, in the preferred embodiment the triple blade element 1A is approximately 6.560 inches in total width, the double blade element 1B is approximately 4.56 inches in width, and the single blade element is approximately 2.56 inches in width, with horizontal portions 42 separated by approximately 2.0 inches. The length of the triple, double and single blade elements 1A, 1B, 1C depends upon the size of the window or door opening. For example, a storm shutter according to the embodiment illustrated in FIG. 1 configured to span a 48 inch window includes two shutter panels 2 that are about 24 inches wide, each including triple, double and single blade elements 1A, 1B, 1C that are about 21.5 inches in length.

In an embodiment, the joint transition portion 54 is approximately twice the thickness of the rest of the triple blade element 1A, and in a preferred embodiment, the joint transition portion 54 is approximately 0.132 inches thick. In an embodiment, the vertical overlap portion 56 and vertical gap 58 are approximately equal to the thickness of the rest of the triple blade element 1A, and in a preferred embodiment, the vertical overlap portion 56 is approximately 0.062 inches thick and the vertical gap 58 is approximately 0.07 inches in thickness and approximately 0.5 to 4 inches in length. So configured, adjacent blade elements can fit smoothly together to present an even blade pattern on the shutter panel 2, while providing increased structural strength at the point of joining without the need for additional fasteners or attachment structures. By eliminating the need for interlocking, welding, riveting or otherwise joining adjacent blade elements (as is the norm in conventional storm shutters), assembly is facilitated since adjacent blade elements can simply be slid together as they are inserted into the side frames 4.

While the dimensional values for the triple, double and single blade elements 1A, 1B, 1C shown in the figures and described above reflect those of a preferred embodiment, they are not intended to limit the scope of the invention or the claims. Shutter blade elements with different blade profiles characterized by different dimensional values as may be used without departing from the scope and spirit of the present invention.

The innovative corrugated profile of the triple, double and single blade elements 1A, 1B, 1C provides high bending strength with relatively thin material cross-section. For example, the configuration of the back vertical portion 52 and front vertical cantilever portion 44 connected to the horizontal portion 42 provides bending strength characteristics similar to those of an I-beam, while the diagonal portion 48 resists torsional loads and distributes pressures applied to the back vertical portion 52. By employing the corrugated profile shown in FIGS. 4-6, the blade elements eliminate the need for a solid back plane structure as used in most conventional shutter designs, thereby reducing weight and material costs. As a consequence of the corrugated blade design, the shutter blades 1 are able to withstand high impact forces without failure, distributing such forces to the side frames 4. Further, the design of the triple, double and single blade elements 1A, 1B, 1C provides approximately equal bending strength in both directions perpendicular to the shutter blade plane (i.e. parallel to the horizontal member 42) so that the shutter blades 1 are effective in resisting both positive and negative pressures as may be experienced in severe weather. Being extruded as a single pieces, the triple, double and single blade elements 1A, 1B, 1C are also affordable to manufacture, and due to the non-interlocking underlap/overlap joints between blade elements, the blade elements are simple to assemble, thus reducing assembly costs.

Figure 7:
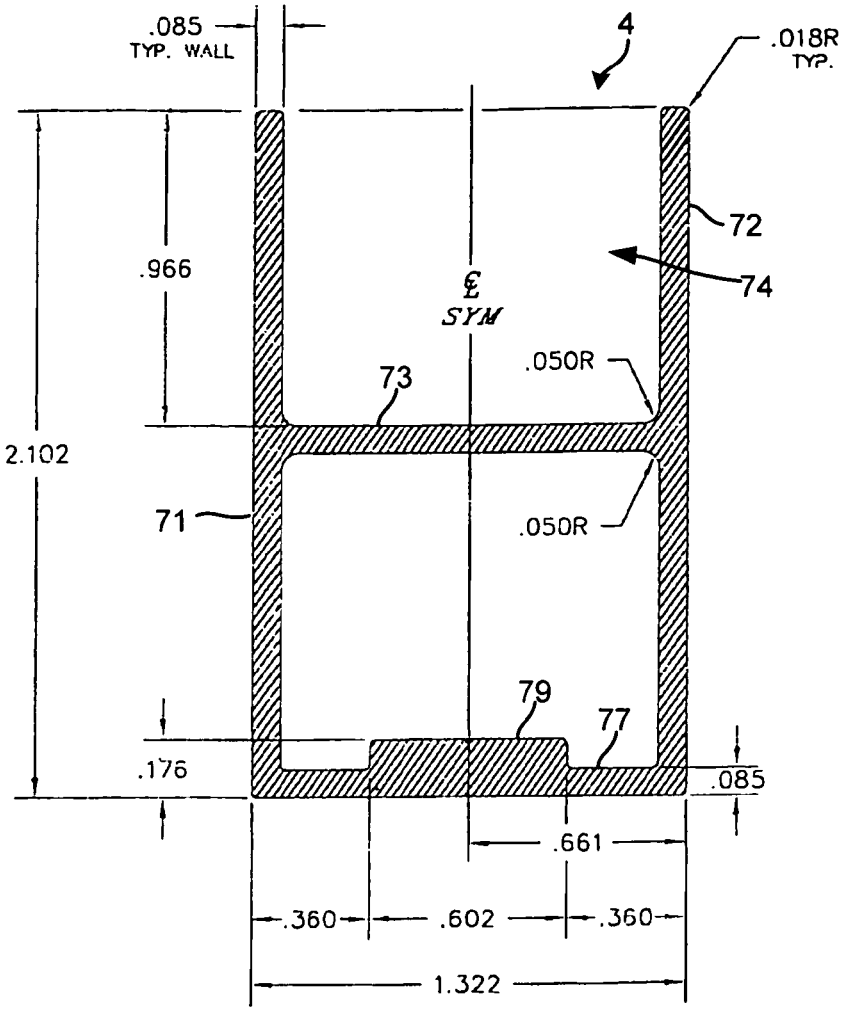
FIG. 7 is a cross-sectional view of a side frame.

FIG. 7 is a cross-sectional view of the side frame 4. The side frame 4 is preferably an extruded aluminum beam with a wall thickness of approximately 0.085 inches in the form of a H with one end closed. More particularly, the side frame 4 includes a first wall 71 and a second wall 72 separated by a perpendicular center wall 73 and an outer wall 77. The space between the first and second walls 71, 72 and the perpendicular center wall 73 forms an opening 74 into which the shutter blades 1 can fit. In a preferred embodiment, the opening 74 has a width of approximately 1.152 inches, which is just slightly larger than the 1.125 inch (approx.) depth of the shutter blades 1. Within the outer wall 77 is provided a thicker reinforcing portion 79 which is approximately centered in the outer wall 77 and runs the entire length of the side frame 4. In an embodiment, this reinforcing portion 79 is approximately twice the thickness of the rest of the side frame 4 structure, and in a preferred embodiment, the reinforcing portion 79 is approximately 0.176 inches thick compared to the rest of the outer wall 77 which is approximately 0.085 inches thick. The thicker reinforcing portion 79 provides greater strength to the side frames 4, particularly in the miter joint where holes are drilled for attachment screws or bolts which thread into the screw bosses 86, 89 in the top and bottom frames 3 (see FIG. 8). The extra thickness in the reinforcing portion 79 allows the holes to be countersunk to provide a flush finish when the miter joints are assembled.

Figure 8:
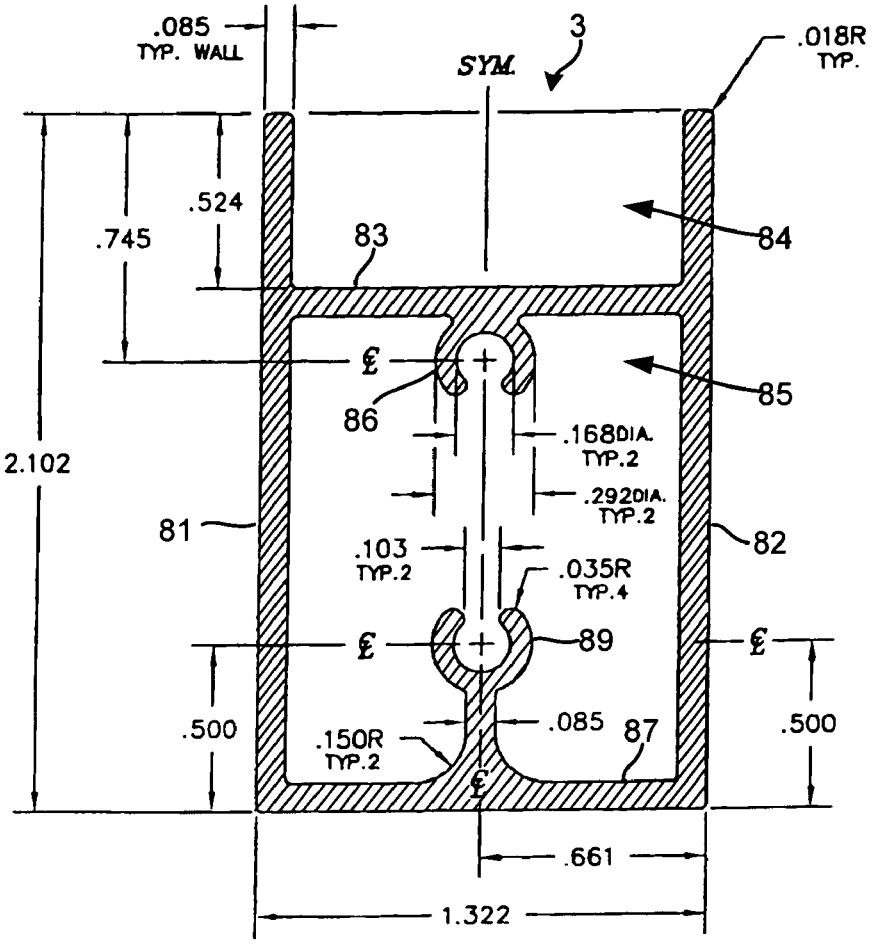
FIG. 8 is a cross-sectional view of a top & bottom frame.

FIG. 8 is a cross-sectional view of the top/bottom frames 3. The top and bottom frame 3 is preferably an extruded aluminum beam with a wall thickness of approximately 0.085 inches in the form of a box with extended legs. More particularly, the top/bottom frame 3 includes a first wall 81 and a second wall 82 separated by a perpendicular center wall 83 and a top/bottom wall 87. The space between the first and second walls 81, 82 and the perpendicular center wall 83 forms an opening 84 into which the shutter blades 1 can fit. In a preferred embodiment, the opening 84 has a width of approximately 1.152 inches, which is just slightly larger than the 1.125 inch (approx.) depth of the shutter blades 1. Within the perpendicular center wall 83 may be provided a first semi-cylindrical screw boss 86 which is approximately centered on the perpendicular center wall 83 and runs the entire length of the top/bottom frame 3. Within the top/bottom wall 87 may be provided a second semi-cylindrical screw boss 89 which is approximately centered in the top/bottom wall 87, provided on a spine 88 and runs the entire length of the top/bottom frame 3. When the miter joints are assembled, machine screws are passed through holes drilled in the ends of the outer walls of the side frames 4 and threaded into the screw bosses 86, 89.

Figure 9:
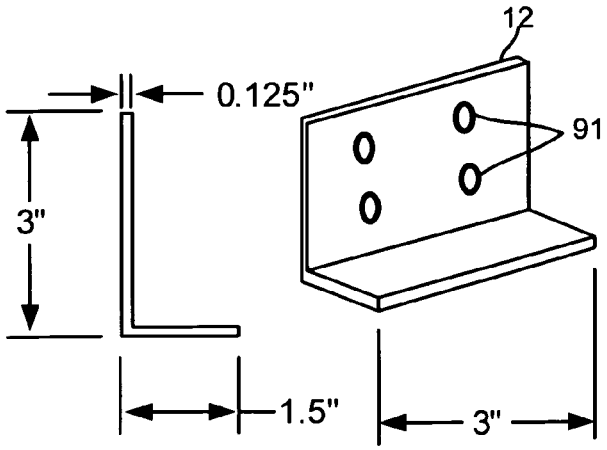
FIG. 9 is an end and oblique view of a center fastening angle.

As mentioned above, one of the key structural elements of the overall shutter assembly is the center fastening angle 12, details of which are illustrated in FIG. 9. This fastener can be a simple "L" shaped piece with pre-drilled holes 91 through which machine bolts 14 can pass in order to couple the center fastening angle 12 to the side frame 4 and top/bottom frame 3 of the shutter panels 2 as described in more below with reference to FIGS. 13 and 15. In a preferred embodiment, the center fastening angle 12 is approximately 0.125 inches thick with a height of about 3 inches, a horizontal extension width of about 1.5 inches and a length of about 3 inches. Using an "L" shaped fastener provides a very rigid structure using less material since the horizontal extension resists bending stress applied to center fastening angle 12.

Figure 10:
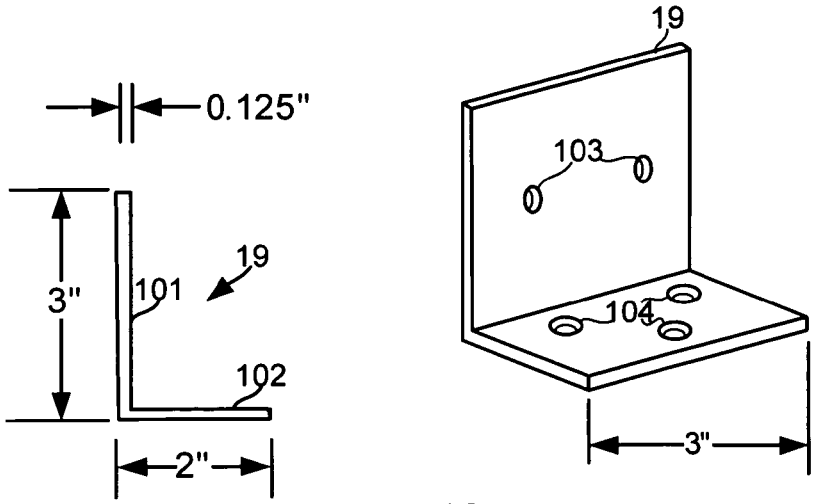
FIG. 10 is an end and oblique view of a center storm bar clip.

Similarly, as shown in FIG. 10, the center storm bar clip 19 is preferably a simple "L" shaped piece with predrilled holes 103 through which machine bolts 14 can pass in order to couple it to the side frame 4 of shutter panels 2 as described below with reference to FIG. 14. The center storm bar clip 19 also includes through-holes 104 in the horizontal extension portion through which mechanical fasteners 13 can be used to couple the center storm bar clip 19 to the storm bar 10 as described below with reference to FIGS. 12B and 14. In a preferred embodiment, the center storm bar clip 19 is made of aluminum with a thickness of approximately 0.125 inches, with a height of about 3 inches, a horizontal extension width of about 2 inches, and a length of about 3 inches.

Figure 11:
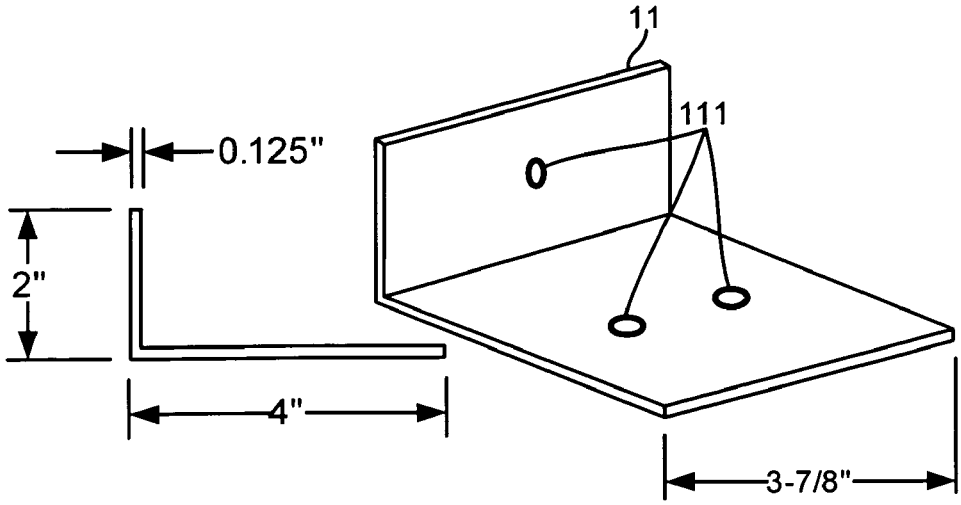
FIG. 11 is an end and oblique view of a wall fastening angle.

As shown in FIG. 1 and discussed in more detail below with reference to FIG. 18, the storm bar 10 may be attached to the building structure when the storm shutter is in the closed configuration. FIG. 11 shows details of a wall fastening angle 11 suitable for accomplishing this attachment. The wall fastening angle 11 may be a simple "L" shaped piece with predrilled bolt holes 111 for bolting the wall fastening angle 11 to the storm bar 10 and to the building structure. In an embodiment, the wall fastening angle 11 is made of 0.125 inch thick aluminum with a height dimension (i.e., short leg length) of about 2 inches, a width dimension (i.e., long leg length) of about 4 inches and a length of about 3.34 inches (~3⅞ inches). Attachment of the wall fastening angle 11 to the storm bar 10 and building structure are described below with reference to FIG. 18.

Figure 12A:
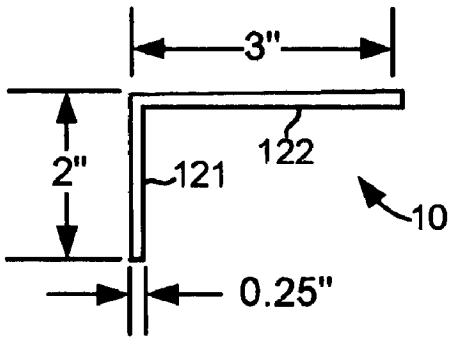
FIG. 12A is an end view of a storm bar.
Figure 12B:
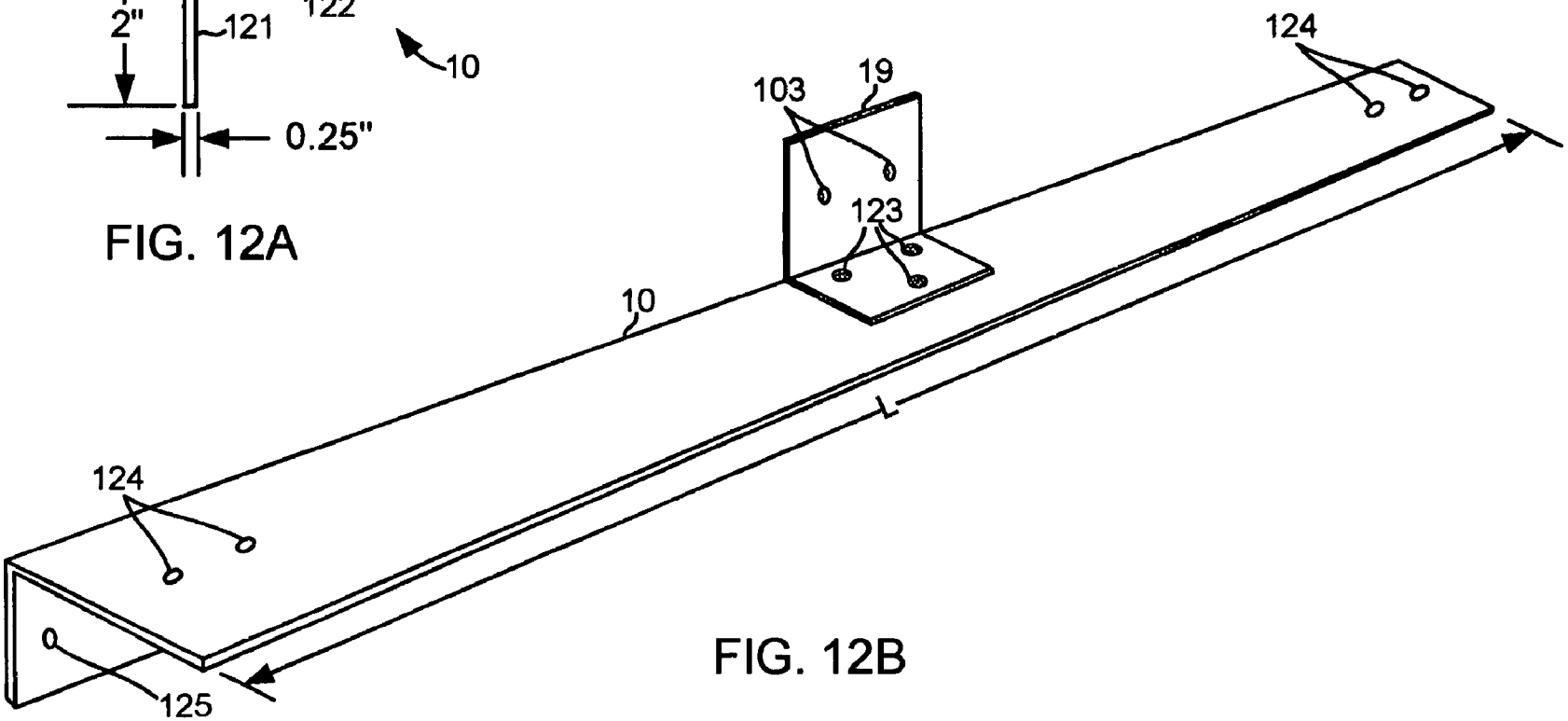
FIG. 12B is an oblique view of a storm bar assembly including a center storm bar clip.

The storm bar 10 enhances the strength of the storm shutter assembly in the closed configuration by distributing loads applied to the inner side frames 4 applied to the center storm bar clip 19 to the building and working in combination with the upper and lower center fastening angles 12 to keep the shutter panels 2 closed. FIGS. 12A and 12B show details of the storm bar configuration according to preferred embodiment. The storm bar 10 may be configured as an "L" shaped beam, however, other configurations may be utilized, including square or triangular channel beams. In a preferred embodiment the "L" shaped beam is formed from 0.25 inch thick aluminum with a height dimension (i.e., length of the vertical leg 121) of about 2 inches and a width dimension (i.e., length of the horizontal leg 122) of about 3 inches. The storm bar 10 may be fabricated by extrusion, or from aluminum plate, such as by bending or welding to form the "L" shape. The center storm bar clip 19 is joined to the storm bar 10 by mechanical fasteners, such as bolts or rivets 123, or by welding (not shown). Through holes 124, 125 may be drilled in the storm bar 10 for accommodating bolts for attaching the wall fastener angle 11 as described below with reference to FIG. 18, or for attaching the storm bar 10 directly to shutter side frames 4 as described below with reference to FIG. 20. The full length "L" of the storm bar 10 depends upon the size of the structure opening covered by the storm shutter. For example, in the embodiment illustrated in FIG. 1 in which the storm shutter assembly is 48 inches wide, the storm bar 10 may be about 56-57 inches in length, while in the bifold embodiment illustrated in FIG. 3, the storm bars 10 may be about 120-121 inches in length.

Figure 13:
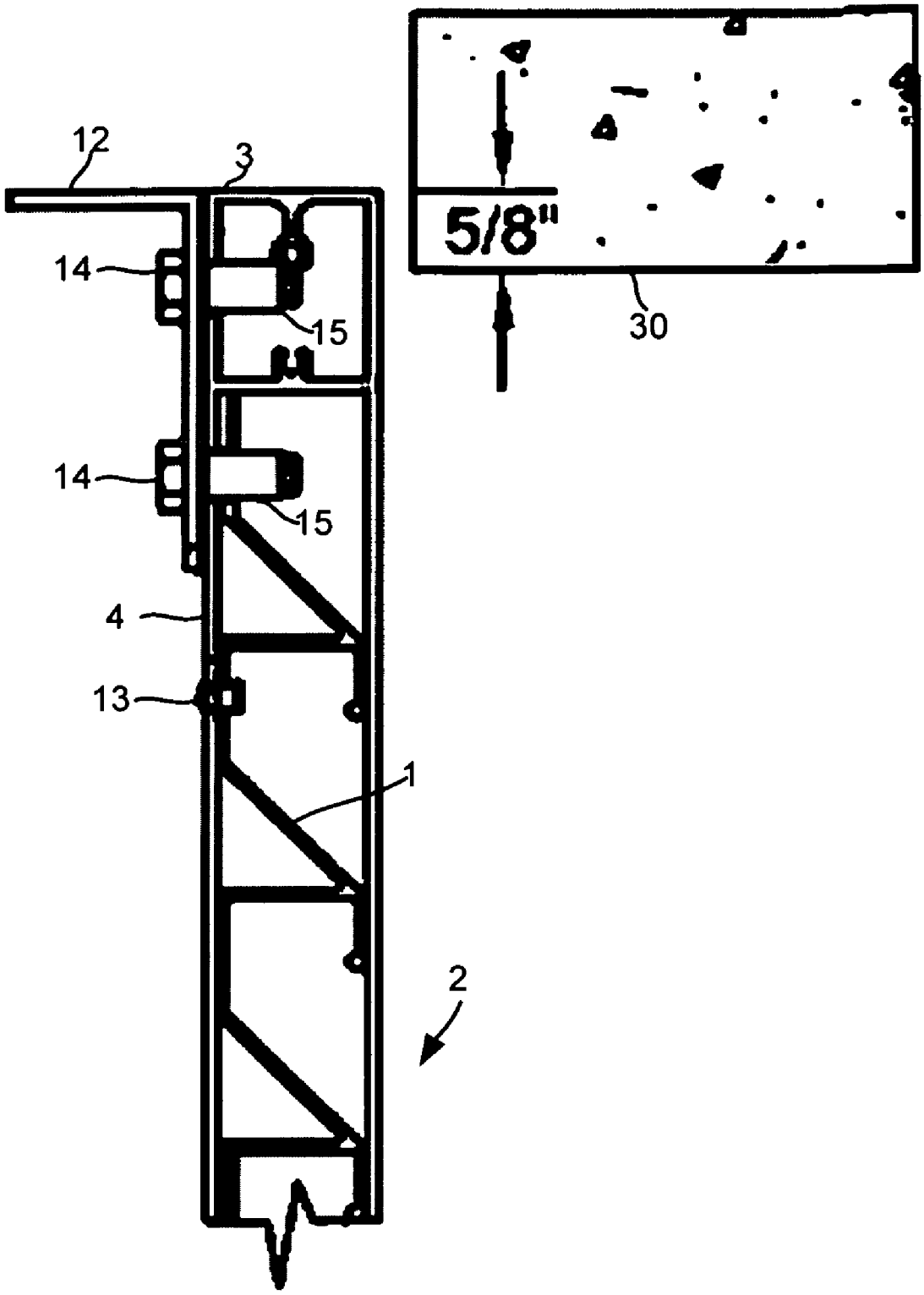
FIG. 13 is a vertical cross-sectional assembly view of the storm shutter assembly illustrated in FIG. 1 through a top portion including the center fastening angle.

Details regarding assembly of the top portion of shutter panels 2 and attachment of the center fastening angle 12 are illustrated in the cross-sectional view shown in FIG. 13. The shutter panel is formed by fitting shutter blades 1 into the opening 74 in the side frame 4. At intervals, the shutter blades 1 may be fixed to the side frame 4 by a mechanical fastener 13, such as rivets or pop rivets. At the top of the shutter panel, a top frame 3 is fitted over the shutter blades 1 and attached to the side frames 4. To provide a threaded receptor for machine bolts 14 used to attach the center fastening angle 12 to the shutter panel 2, rivnuts 15 may be positioned in the top frame 3 and side frame 4. Rivnuts 15, which are well-known in the industry, are metal inserts that provide a female fastener which are positioned in a pre-drilled hole and then expanded like a rivet to form a threaded attachment point secured to the structure. The interior of the rivnut 15 is threaded to accommodate a bolt 14. The center fastening angle 12 can then be attached to the shutter panel 2 by passing machine bolts 14 through the predrilled holes 121 in the center fastening angle 12 and threading them into the rivnuts 15. FIG. 13 also illustrates how in a preferred embodiment the shutter assembly is sized to overlap building structure 30, such as by ⅝ inch, to ensure proper protection for the window.

Figure 14:
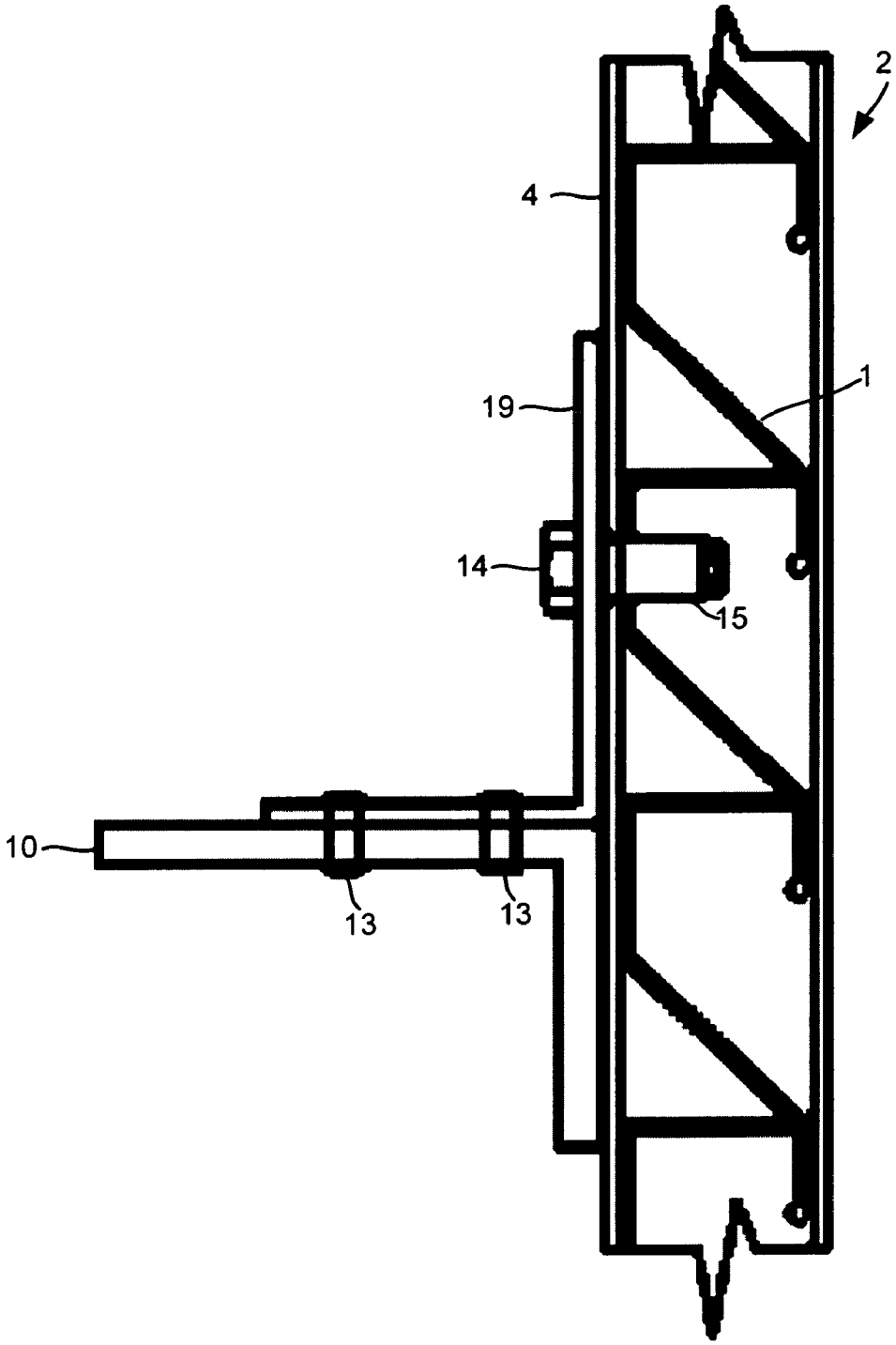
FIG. 14 is a vertical cross-sectional assembly view of the storm shutter assembly illustrated in FIG. 1 through a center portion including the storm bar.

Details regarding assembly of the center portion of shutter panels 2 and the attachment of the center storm bar clip 19 are illustrated in the cross-sectional view shown in FIG. 14. As discussed above, the shutter panel 2 is formed by fitting shutter blades 1 into the opening 74 in the side frame 4. To provide a threaded receptor for machine bolts 14 for attaching the center storm bar clip 19, rivnuts 15 may be positioned in the side frame 4. The center storm bar clip 19 can then be attached to the center portion of the storm shutter assembly by threading machine bolts 14 through the predrilled holes 103 in the center storm bar clip 19 and into the rivnuts 15. FIG. 14 also illustrates how the center storm bar clip 19 can be attached to the storm bar 10 by mechanical fasteners 13 (such as rivets as illustrated or nuts and bolts) positioned in the pre-drilled holes 104 of the center storm bar clip 19 and in the storm bar 10. As can be seen in FIG. 14, attaching the center storm bar clip 19 with machine bolts 14 to the side frame 4 rigidly attaches the strong storm bar 10 to the shutter panel 2, thereby providing structural reinforcement for the center portion of the storm shutter assembly.

Figure 15:
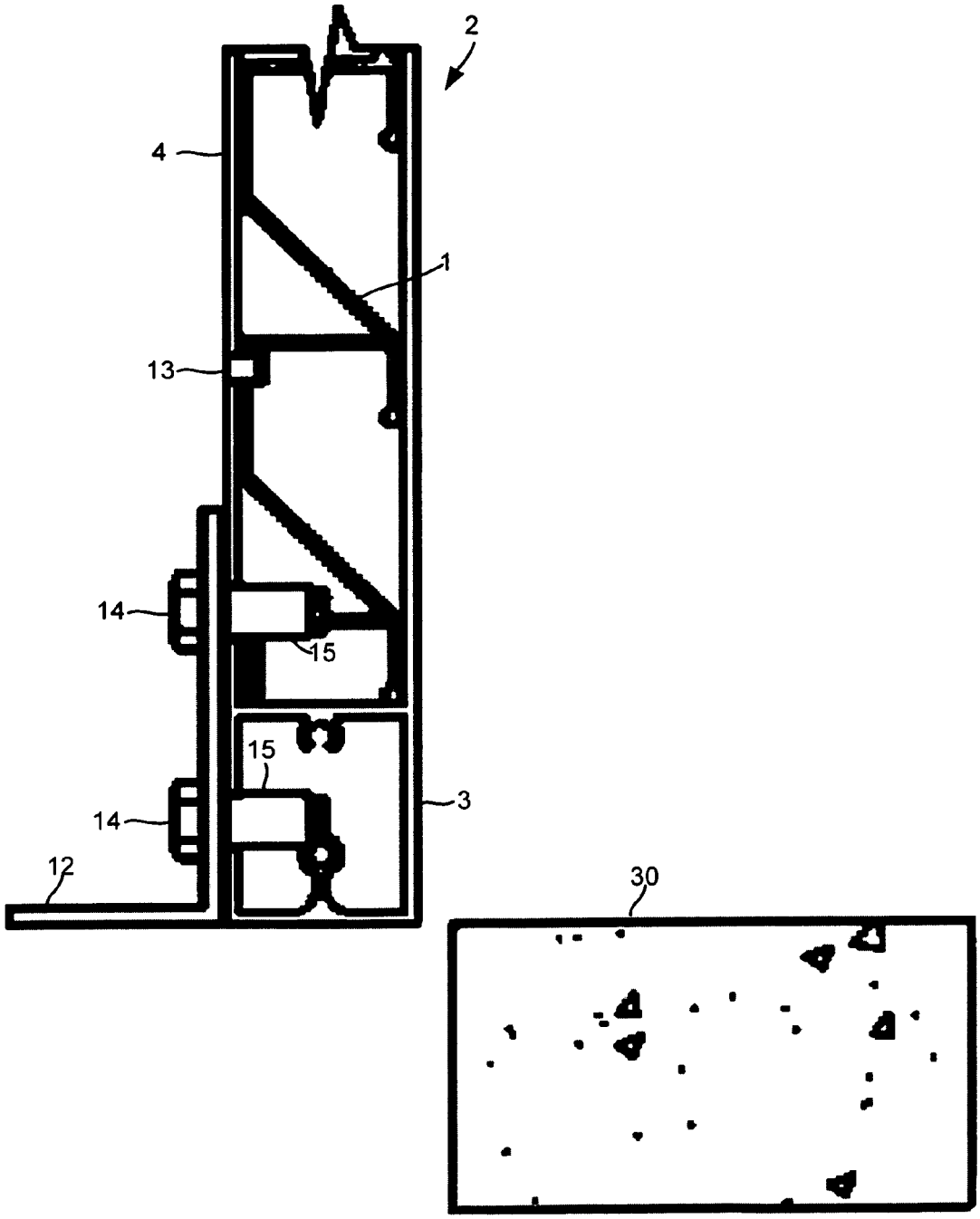
FIG. 15 is a vertical cross-sectional assembly view of the storm shutter assembly illustrated in FIG. 1 through a bottom portion including the center fastening angle.

Details regarding assembly of the bottom portion of shutter panels 2 and the attachment of the center fastening angle 12 are illustrated in the cross-sectional view shown in FIG. 15. At the bottom of the shutter panel, a bottom frame 3 is fit over the shutter blades 1. To provide a threaded receptor for machine bolts 14, rivnuts 15 may be positioned in the bottom frame 3 and side frame 4. The center fastening angle 12 can then be attached to the storm shutter assembly by passing machine bolts 14 through the predrilled holes 121 in the center fastening angle 12 and threading them into the rivnuts 15.

Figure 16:
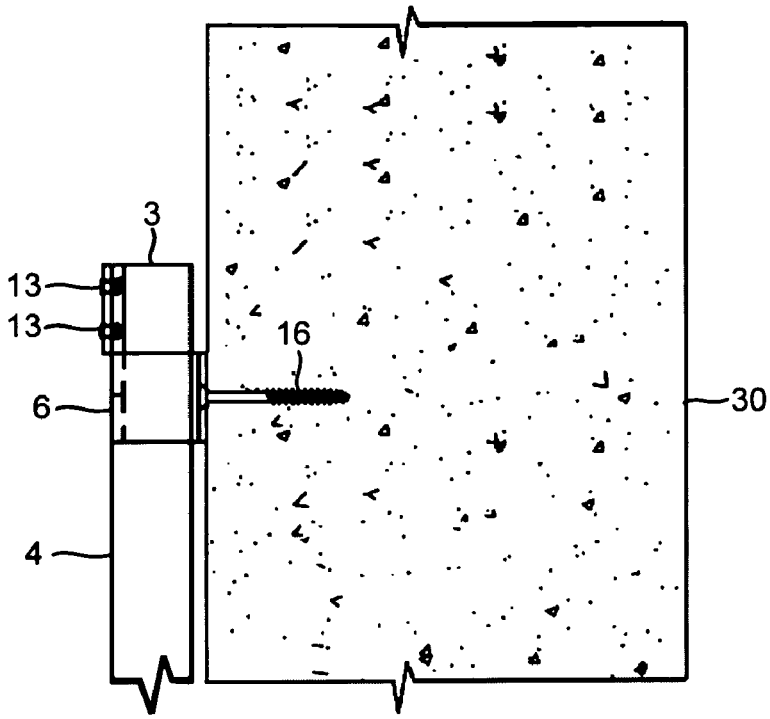
FIG. 16 is an edge and cross-sectional view of a top portion of the storm shutter assembly illustrated in FIG. 1 showing details of attachment to a structure.
Figure 17:
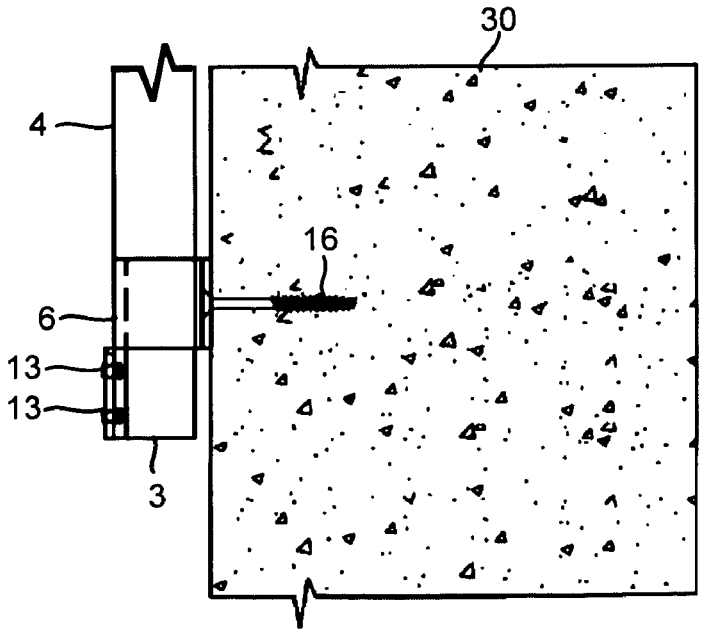
FIG. 17 is an edge and cross-sectional view of a bottom portion of the storm shutter assembly illustrated in FIG. 1 showing details of attachment to a structure.

Details regarding attachment of the top portion of the shutter panels 2 to building structure are illustrated in FIG. 16 and details regarding attachment of the bottom portion of the shutter panels 2 to building structure are illustrated in FIG. 17. Further details of the attachment of the shutter panels 2 to building structure 30, 32 are illustrated in FIG. 18, which is a cross-sectional view representative of both the top and bottom portions of the shutter panel. Referring to FIGS. 16-18, each of the shutter panels 2 are attached to a building structure by a plurality of hinges 6, such as by means of lag screws 17 for mounting the hinges upon wooden frames, masonry anchors such as Tapcons® 16 for mounting the hinges upon masonry frames, or other mechanical attachments. The lag screws 17 may be driven directly into a wood window frame as illustrated on the left hand portion of FIG. 18, while Tapcons® 16 may be driven directly into concrete structure as illustrated in FIGS. 16, 17 and the right hand portion of FIG. 18. In a preferred embodiment, lag screws 17 used to mount hinges 6 to wood window frames 32 are inserted a minimum of 2½ inches, and Tapcons® 16 mounting hinges 6 to masonry frames 30 are inserted a minimum of 1¼ inches. In a preferred embodiment, the lag screws 17 or Tapcons® 16 are spaced about 2 inches apart in the building-side of the hinges 6.

Figure 18:
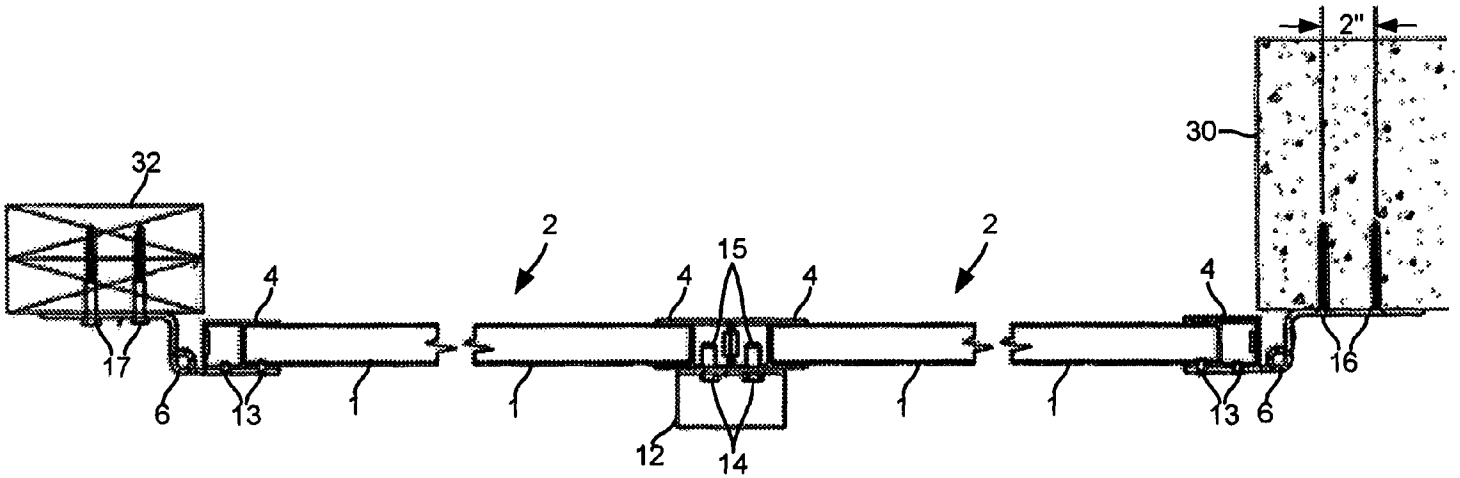
FIG. 18 is a horizontal cross-sectional assembly view of a top portion of the storm shutter assembly illustrated in FIG. 1.

FIGS. 16-18 also show how the shutter-side portion of the hinge 6 can be attached to the shutter side frame 4 by mechanical fasteners 13, such as rivets or pop rivets.

FIG. 18 also provides another view showing how the shutter blades 1 are positioned within the openings 74 within the side walls 4, and another view of the details for attaching a center fastening angle 12 to the shutter side frames 4 by machine bolts 14 threaded into rivnuts 15.

Figure 19:
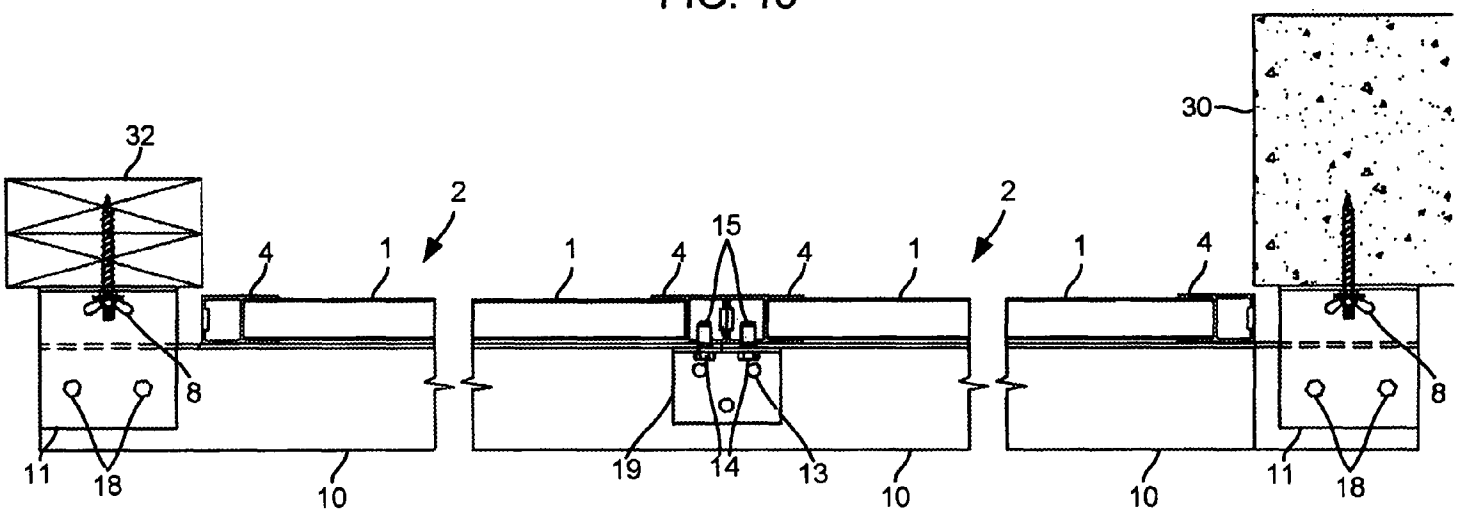
FIG. 19 is a horizontal cross-sectional assembly view of the middle portion of the storm shutter assembly illustrated in FIG. 1.

FIG. 19 provides a cross-sectional view of the center portion of the shutter assembly showing additional details regarding the attachment of the storm bar 10 to shutter panels 2 and building structure 30, 32. FIG. 19 shows how the storm bar 10 can be attached to building structure 30, 32 in the embodiment illustrated in FIG. 1. Specifically, the wall fastening angle 11 can be attached to the storm bar 10 by fasteners such as nuts and bolts 18, and the wall fastening angle 11 can be attached to the building structure 30, 32 by a wingnut and threaded fastener 8. The wingnut and threaded fastener 8 includes a threaded fastener which is driven into the building structure 30, 32 leaving exposed a threaded portion which matches the threads of the wingnut. Commercially available threaded fasteners 8 suitable for use in an embodiment are marketed by Elco®, an Acument Global Technologies Company, under the trademark PanelMate®. In this embodiment, the storm bar 10 can be is attached to the structure simply by positioning the wall fastening angle 11 over threaded fastener portion attached to the structure and threading on a wingnut. FIG. 19 also shows again how the shutter blades 1 are positioned within the openings 74 within the side walls 4, and how the center storm bar clip 19 is attached to the center portions of the shutter panels 2 by machine bolts 14 threaded into rivnuts 15 mounted within the side frames 4.

Figure 20:
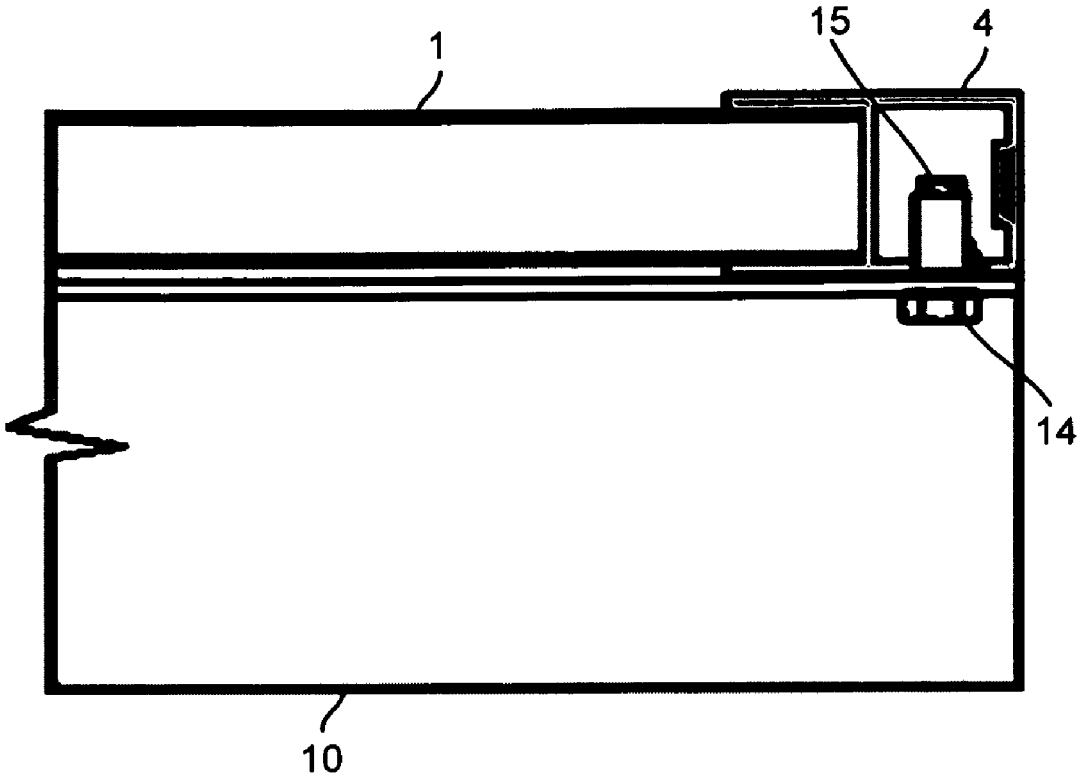
FIG. 20 is a horizontal cross-sectional detail view of an attachment portion of bar and storm shutter assembly illustrated in FIG. 2.

In an alternative embodiment illustrated in FIGS. 2 and 20, the storm bar 10 can be attached to the outer side frames 4 by a machine bolt 14 positioned in the through hole 123 in the storm bar 10 shown in FIG. 12B and threaded into a rivnut 15 attached to the side wall 4. FIG. 20 provides a detailed cross-sectional view of this attachment viewed from beneath the storm bar 10.

The various embodiments described above provide a strong shutter design which is easily assembled. In an embodiment, the shutter panels can be assembled as follows. A bottom frame 3 can be attached to two side frames 4 by drilling holes in the outer walls 77 near the ends of the two side frames 4, passing machine screws through these holes and threading them into the screw bosses 86, 89 in the bottom frame 3. As discussed above with reference to FIG. 7, these holes are drilled through the thicker reinforcing portion 79 of the side frames 3, and thus can be countersunk so the screws are flush when installed without compromising the strength of the outer wall 77. With the side and bottom frames assembled, triple blade elements 1A can be slide into the openings 74 within the side frames 4 from the top end of the frames until the height of the shutter panel 2 is filled. To accommodate different size shutters, double or single blade elements 1B, 1C can be included in the shutter panels 2. Since the triple, double and single blade elements 1A, 1B, 1C simply overlap and do not include interlocking pieces, the assembly of the blade elements can proceed quickly. When the full height of the side frames 4 has been filled with triple blade, double blade and/or single blade elements 1A, 1B, 1C, a top frame 3 can be attached to the two side frames 4. Again, the miter joints are assembled by passing machine screws through holes drilled in the ends of the outer walls 77 of the side frames 4 and threading them into the screw bosses 86, 89 within the top frame 3. Hinges 6 are then attached to one side frame 4 at the top and bottom corners and at intervals there between. At the top and bottom corners, the shutter-side of the hinges 6 are attached to both the top/bottom frame 3 and side frame 4. At intervals along the length of the side frames 4, such as approximately every 16 inches, mechanical fasteners 13 (such as pop rivets) are used to attach the shutter blades 1 to the side frames 4. Finally, rivnuts holes are drilled in the side frames 4 and top/bottom frames 3, and rivnuts 15 are inserted and expanded in order to form a proper mechanical fit within the frames. At this point, the shutter panel 2 is ready for assembly on a structure. Shutter panels may be painted or coated with protective materials before or after assembly. This simple assembly process and reduced material count reduces the cost of manufacturing the storm shutters.

To install shutter assemblies on buildings, contractors merely need to attach the hinges 6 to the opening frame in the structure such as by using lag screws 17 or Tapcons® 16 (as appropriate). When installing the embodiment illustrated in FIG. 1, the wingnuts and threaded fasteners 8 are also driven into the structure at the centerline of the window or door opening to accommodate the storm bar. This simple attachment process reduces the cost of installing the storm shutters.

To position the storm shutters in the closed configuration, the shutter panels 2 on either side of the window or door are pivoted about the hinges 6 into the closed position. Center fastening angles 12 are attached at the bottom and top of the storm shutter by threading machine bolts 14 through the holes 91 in the center fastening angles 12 and into the rivnuts 15 within the side frames 4 and bottom/top frames 3. The storm bar 10 is attached either to the side frames 4 by machine bolts 14 threaded into rivnuts 15 within the side frames 4 (for the embodiment shown in FIG. 2) or to the structure by positioning the wall fastening angle 11 over threaded faster portion attached to the structure and threading on a wingnut 8 (for the embodiments shown in FIGS. 1 and 3). The center storm bar clip 19 is attached to the inner side frames 4 by threading machine bolts 14 through the holes 103 in the clip and into the rivnuts 15 within the side frames 4. No further assembly steps are required. This simple deployment process allows home and business owners to deploy their storm shutters more quickly than is the case with conventional storm shutters, and thereby provide more time for them to evacuate if needed. In the case of an average sized home, this simple installation process can save typical home owners two to three hours, which can be significant when evacuation is required.

In a preferred embodiment all of the aluminum components (e.g., shutter blade elements 1A, 1B, 1C, top/bottom frames 3, side frames 4, hinges 6, storm bar 10, wall fastening angle 11, center fastening angle 12, and center storm bar clip 19) can be made from Aluminum 6063-T5. However, other materials may be used, such as other aluminum alloys and higher strength materials as would be appreciated by one of skill in the art.

The foregoing description of the various embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein, and instead the claims should be accorded the widest scope consistent with the principles and novel features disclosed herein.

I claim:

1. A colonial storm shutter, comprising:

a storm bar having a first and second end and a center storm bar clip attached to the storm bar at an intermediate point between the first and second ends;

first and second center fastening angle; and two shutter panels, each shutter panel comprising:

a bottom frame;

first and second side frames adjoining the bottom frame, the first and second side frames having a cross-sectional shape in the form of a H with a first open end and a second closed end by an outer wall having a reinforced portion approximately centered on the outer wall;

a top frame adjoining the first and second side frames;

a top hinge attached by fasteners to the first side frame and the top frame, the top hinge configured to attach the shutter panel to a building structure;

a bottom hinge attached by fasteners to the first side frame and the bottom frame, the bottom hinge configured to attach the shutter panel to the building structure; and a plurality of shutter blade elements extending between the first and second side frames, each of the plurality of shutter blade elements having a corrugated cross-sectional shape including:

a horizontal portion;

a diagonal portion connected to the horizontal portion at an acute angle;

a front vertical cantilever portion connected at approximately a right angle to the horizontal portion and at an obtuse angle to the diagonal portion; and a back vertical portion connected to the diagonal portion at an obtuse angle, wherein when the colonial storm shutter is in a closed configuration:

the center storm bar clip is bolted to the second side frame of each of the two shutter panels;

the first center fastening angle is bolted to the top frame and second side frame of each of the two shutter panels; and the second center fastening angle is bolted to the bottom frame and second side frame of each of the two shutter panels.

2. The colonial storm shutter of claim 1, wherein each of the plurality of shutter blade elements further includes:

a vertical underlap portion connected at approximately a right angle to the horizontal portion; and a joint transition portion including an overlap portion and a vertical gap, wherein the vertical gap is configured to accommodate the vertical underlap portion of an adjoining shutter blade element so that the overlap portion overlaps the underlap portion of the adjoining shutter blade element when the shutter blade elements are assembled in the shutter panel.

3. The colonial storm shutter of claim 1, wherein:

the plurality of shutter blade elements are each extruded aluminum forms having a thickness of about 0.062 inches;

a front surface of the front vertical cantilever portion and a back surface of the back vertical portion are separated by a horizontal distance of about 1.125 inches;

each horizontal portion is separated by a vertical distance of about 2 inches;

the acute angle between the diagonal portion and the horizontal portion is about 45 degrees;

the obtuse angle between the front vertical cantilever portion the diagonal portion is about 135 degrees; and the obtuse angle between the diagonal portion and the back vertical portion is about 135 degrees.

4. The colonial storm shutter of claim 1, wherein on each of the two shutter panels:

the top hinge is attached to the first side frame with two fasteners and to the top frame with two fasteners; and the bottom hinge is attached to the first side frame with two fasteners and to the bottom frame with two fasteners.

5. The colonial storm shutter of claim 1, wherein the fasteners are rivets.

6. The colonial storm shutter of claim 1, wherein the fasteners are pop rivets.

7. The colonial storm shutter of claim 1, wherein the storm bar is bolted to the first side frame of each of the two shutter panels when the colonial storm shutter is in a closed configuration.

8. The colonial storm shutter of claim 1, wherein the storm bar is bolted to the building structure when the colonial storm shutter is in the closed configuration.

9. The colonial storm shutter of claim 1, wherein the center storm bar clip and top and bottom fastening angles are bolted to the second side frames by machine bolts threaded into rivnuts mounted in the second side frames of each of the two shutter panels.

10. The colonial storm shutter of claim 1, wherein:

the first open end of the H cross-sectional shape of the first and second side frames is configured to receive the plurality of shutter blade elements; and a portion of the plurality of shutter blade elements are fit into the first open end of the H cross-sectional shape of the first and second side frames.

11. A bifold colonial storm shutter, comprising:

a storm bar having a first and second end and a center storm bar clip attached to the storm bar at an intermediate point between the first and second ends;

first and second center fastening angle; and first, second, third and fourth shutter panels, each of said first, second, third, and fourth shutter panels comprising:

a bottom frame;

first and second side frames adjoining the bottom frame, the first and second side frames having a cross-sectional shape in the form of a H with a first open end and a second closed end by an outer wall having a reinforced portion approximately centered on the outer wall;

a top frame adjoining the first and the second side frames; and a plurality of shutter blade elements extending between the first and second side frames, each of the plurality of shutter blade elements having a corrugated cross-sectional shape including:

a horizontal portion;

a diagonal portion connected to the horizontal portion at an acute angle;

a front vertical cantilever portion connected at approximately a right angle to the horizontal portion and at an obtuse angle to the diagonal portion; and a back vertical portion connected to the diagonal portion at an obtuse angle, wherein:

the first shutter panel comprises:

a first top mounting hinge attached by fasteners to the first side frame and to the top frame of the first shutter panel, the first top mounting hinge configured to attach the first shutter panel to a building structure;

a first bottom mounting hinge attached by fasteners to the first side frame and the bottom frame of the first shutter panel, the first mounting bottom hinge configured to attach the first shutter panel to the building structure;

a first top bifold hinge attached by fasteners to the second side frame and to the top frame of the first shutter panel; and a first bottom bifold hinge attached by fasteners to the second side frame and the bottom frame of the first shutter panel;

the first top bifold hinge is attached by fasteners to the first side frame and the top frame of the second shutter panel;

the first bottom bifold hinge is attached by fasteners to the first side frame and the bottom frame of the second shutter panel;

the third shutter panel comprises:

a second top bifold hinge attached by fasteners to the first side frame and the top frame of the third shutter panel; and a second bottom bifold hinge attached by fasteners to the first side frame and the bottom frame of the third shutter panel;

the fourth shutter panel comprises:

a second top mounting hinge attached by fasteners to the first side frame and to the top frame of the fourth shutter panel, the second top mounting hinge configured to attach the fourth shutter panel to the building structure; and a second bottom mounting hinge attached by fasteners to the first side frame and the bottom frame of the fourth shutter panel, the second mounting bottom hinge configured to attach the fourth shutter panel to the building structure;

the second top bifold hinge is attached by fasteners to the second side frame and the top frame of the fourth shutter panel; and the second bottom bifold hinge is attached by fasteners to the second side frame and the bottom frame of the fourth shutter panel;

wherein when the bifold colonial storm shutter is in a closed configuration:

the center storm bar clip is bolted to the second side frame of each of the second and third shutter panels;

the first center fastening angle is bolted to the top frame and second frame of each of the second and third shutter panels; and the second center fastening angle is bolted to the bottom frame and second frame of each of the second and third shutter panels.

12. The bifold colonial storm shutter of claim 11, wherein each of the plurality of shutter blade elements further includes:

a vertical underlap portion connected at approximately a right angle to the horizontal portion; and a joint transition portion including an overlap portion and a vertical gap, wherein the vertical gap is configured to accommodate the vertical underlap portion of an adjoining shutter blade element so that the overlap portion overlaps the underlap portion of the adjoining shutter blade element when the shutter blade elements are assembled in the shutter panel.

13. The bifold colonial storm shutter of claim 11, wherein:

the plurality of shutter blade elements are each extruded aluminum forms having a thickness of about 0.062 inches;

a front surface of the front vertical cantilever portion and a back surface of the back vertical portion are separated by a horizontal distance of about 1.125 inches;

each horizontal portion is separated by a vertical distance of about 2 inches;

the acute angle between the diagonal portion and the horizontal portion is about 45 degrees;

the obtuse angle between the front vertical cantilever portion the diagonal portion is about 135 degrees; and the obtuse angle between the diagonal portion and the back vertical portion is about 135 degrees.

14. The bifold colonial storm shutter of claim 11, wherein:

each of the first and second top hinges is attached to the respective first side frame with two fasteners and to the respective top frame with two fasteners; and each of the first and second bottom hinge is attached to the respective first side frame with two fasteners and to the respective bottom frame with two fasteners.

15. The bifold colonial storm shutter of claim 11, wherein the fasteners are rivets.

16. The bifold colonial storm shutter of claim 11, wherein the storm bar is bolted to the building structure when the bifold colonial storm shutter is in the closed configuration.

17. The bifold colonial storm shutter of claim 11, further comprising two additional storm bars which do not include a center storm bar clip, the two additional storm bars being bolted to a building structure when the colonial storm shutter is in a closed configuration.

18. The bifold colonial storm shutter of claim 11, wherein the center storm bar clip and top and bottom fastening angles are bolted to the respective second side frames by machine bolts threaded into rivnuts mounted in the respective second side frames.

19. The bifold colonial storm shutter of claim 11, wherein for each of said first, second, third, and fourth shutter panels:

the first open end of the H cross-sectional shape of each of the first and second side frames is configured to receive the plurality of shutter blade elements; and a portion of the plurality of shutter blade elements are fit into the first open end of the H cross-sectional shape of the first and second side frames.

20. The bifold colonial storm shutter of claim 11, wherein the storm bar is bolted to each of the first and second side frames of each of said first, second, third, and fourth shutter panels when in the closed configuration by machine bolts threaded into rivnuts mounted in the respective side frames.

21. A bifold colonial storm shutter, comprising:

three storm bars;

first and second center fastening angle; and first, second, third and fourth shutter panels, each of said first, second, third, and fourth shutter panels comprising:

a bottom frame;

first and second side frames adjoining the bottom frame, the first and second side frames having a cross-sectional shape in the form of a H with a first open end and a second closed end by an outer wall having a reinforced portion approximately centered on the outer wall;

a top frame adjoining the first and the second side frames;

a plurality of shutter blade elements extending between the first and second side frames, each of the plurality of shutter blade elements having a corrugated cross-sectional shape including:

a horizontal portion;

a diagonal portion connected to the horizontal portion at an acute angle;

a front vertical cantilever portion connected at approximately a right angle to the horizontal portion and at an obtuse angle to the diagonal portion; and a back vertical portion connected to the diagonal portion at an obtuse angle, wherein:

the first shutter panel comprises:

a first top mounting hinge attached by fasteners to the first side frame and to the top frame of the first shutter panel, the first top mounting hinge configured to attach the first shutter panel to a building structure;

a first bottom mounting hinge attached by fasteners to the first side frame and the bottom frame of the first shutter panel, the first mounting bottom hinge configured to attach the first shutter panel to the building structure;

a first top bifold hinge attached by fasteners to the second side frame and to the top frame of the first shutter panel; and a first bottom bifold hinge attached by fasteners to the second side frame and the bottom frame of the first shutter panel;

the first top bifold hinge is attached by fasteners to the first side frame and the top frame of the second shutter panel;

the first bottom bifold hinge is attached by fasteners to the first side frame and the bottom frame of the second shutter panel;

the third shutter panel comprises:

a second top bifold hinge attached by fasteners to the first side frame and the top frame of the third shutter panel; and a second bottom bifold hinge attached by fasteners to the first side frame and the bottom frame of the third shutter panel;

the fourth shutter panel comprises:

a second top mounting hinge attached by fasteners to the first side frame and to the top frame of the fourth shutter panel, the second top mounting hinge configured to attach the fourth shutter panel to the building structure; and a second bottom mounting hinge attached by fasteners to the first side frame and the bottom frame of the fourth shutter panel, the second mounting bottom hinge configured to attach the fourth shutter panel to the building structure;

the second top bifold hinge is attached by fasteners to the second side frame and the top frame of the fourth shutter panel; and the second bottom bifold hinge is attached by fasteners to the second side frame and the bottom frame of the fourth shutter panel;

wherein when the bifold colonial storm shutter is in a closed configuration:

the three storm bars are each bolted to each of the first and second side frames of each of said first, second, third, and fourth shutter panels when in the closed configuration by machine bolts threaded into rivnuts mounted in the respective side frames;

the first center fastening angle is bolted to the top frame and second frame of each of the second and third shutter panels by machine bolts threaded into rivnuts mounted in the respective top and second frames; and the second center fastening angle is bolted to the bottom frame and second frame of each of the second and third shutter panels by machine bolts threaded into rivnuts mounted in the respective bottom and second frames.

* * * * *